US005478714A

United States Patent [19]

Shuto et al.

[11] Patent Number: 5,478,714

[45] Date of Patent: Dec. 26, 1995

[54] SILVER HALIDE PHOTOGRAPHIC EMULSION AND SILVER HALIDE PHOTOGRAPHIC LIGHT-SENSITIVE MATERIAL

[75] Inventors: Sadanobu Shuto; Hideo Ikeda; Takefumi Hara, all of Minami-ashigara, Japan

[73] Assignee: Fuji Photo Film, Co., Ltd., Kanagawa, Japan

[21] Appl. No.: 204,436

[22] Filed: Mar. 2, 1994

[30] Foreign Application Priority Data

Mar. 2, 1993 [JP] Japan ..... 5-064788

[51] Int. Cl.[6] ..... G03C 1/035; G03C 1/04

[52] U.S. Cl. ..... 430/567; 430/627

[58] Field of Search ..... 430/567, 627

[56] References Cited

U.S. PATENT DOCUMENTS

| | | | |
|---|---|---|---|
| 4,806,461 | 2/1989 | Ikeda et al. | 430/567 |
| 5,096,806 | 3/1992 | Nakamura et al. | 430/567 |
| 5,212,054 | 5/1993 | Tashiro et al. | 430/567 |
| 5,252,453 | 10/1993 | Tsaur et al. | 430/569 |
| 5,262,294 | 11/1993 | Yagi et al. | 430/567 |
| 5,272,048 | 12/1993 | Kim et al. | 430/567 |
| 5,306,611 | 4/1994 | Yagi et al. | 430/567 |

*Primary Examiner*—Janet C. Baxter
*Attorney, Agent, or Firm*—Birch, Stewart, Kolasch & Birch

[57] ABSTRACT

A silver halide photographic emulsion contains tabular silver halide grains having an aspect ratio of 2 or more in an amount of 70% or more of a total projected area of all grains. A variation coefficient of the grain size distribution of all silver halide grains is 20% or less, a signal having at least two peaks is present in a diffraction angle range of less than 1.5 degree at a maximum peak height × 0.13 of a (420) X-ray diffraction signal obtained using the $K_\alpha$ line of Cu, and a peak interval thereof is 0.1 degree or more in terms of the diffraction angle.

11 Claims, 1 Drawing Sheet

SILVER HALIDE PHOTOGRAPHIC EMULSION AND SILVER HALIDE PHOTOGRAPHIC LIGHT-SENSITIVE MATERIAL

BACKGROUND OF THE INVENTION

1. Field of the Invention

The present invention relates to a silver halide photographic emulsion, and a silver halide photographic light-sensitive material containing the photographic emulsion, and more particularly, to a silver halide photographic emulsion having a high sensitivity, a high contrast, an improved pressure-resistant characteristic, and an improved latent image storability, and a silver halide light-sensitive material containing such photographic emulsion.

2. Description of the Related Art

Methods of producing and techniques of using tabular silver halide grains are disclosed in, for example, U.S. Pat. Nos. 4,434,226, 4,439,520, 4,414,310, 4,433,048, 4,414,306 and 4,459,353, and JP-A-59-99433 (JP-A means Published Unexamined Japanese Patent Application), and advantages including the enhancement of spectral sensitization, the improvement of sensitivity/graininess and the improvement of sharpness are discussed in these documents.

Further, JP-A-63-11928, JP-A-63-151618 and EP-514, 4742A disclose techniques in which tabular grains are monodispersed in terms of size distribution, and the ratio of tabular grains present is increased.

However, there are a number of problems with the tabular silver halide grains which should be solved in introducing into a photographic light-sensitive material, especially in durability such as pressure-resistant characteristics and latent image storability.

In the meantime, JP-A-3-168734 and JP-A-3-211543 disclose techniques for improving the color reproducibility and reciprocity failure property by using a silver halide photographic emulsion containing twinned crystal grains having an aspect ratio of 5 or more in an amount of 50% or more of a total projected area of all grains, wherein a (420) X-ray diffraction signal obtained using $K_\alpha$ line of Cu has only one peak, and the diffraction ray width at a maximum peak height×0.13 is less than 1.5 degree or more in terms of angle of diffraction.

Further, JP-A-3-241336 discloses techniques for improving the sensitivity and graininess by using a silver halide photographic emulsion containing twinned crystal grains having an aspect ratio of 5 or more in an amount of 50% or more of a total projected area of all grains, wherein a signal is present over 1.5 degree or more of a diffraction angle at a maximum peak height×0.13 of a (420) X-ray diffraction signal obtained using $K_\alpha$ line of Cu.

However, in these silver halide emulsions, the aspect ratio of the tabular silver halide grains are relatively low, and the monodispersity of the grain size and the ratio of the tabular grains present are not high enough, so that a sufficient improvement effect of the photographic properties, which is an advantage of tabular grains, cannot be obtained. Therefore, there has been a demand for a further improvement of sensitivity and gradation, as well as properties of durability such as pressure-resistant characteristics and latent image storability.

SUMMARY OF THE INVENTION

An object of the present invention is to provide a silver halide photographic emulsion and a silver halide photographic light-sensitive material having a high sensitivity, a high contrast, an improved pressure-resistant characteristic, and an improved latent image storability.

According to the present invention, there is provided a silver halide photographic emulsion containing tabular silver halide grains having an aspect ratio of 2 or more in an amount of 70% or more of the total projected area of all grains, wherein the variation coefficient of the grain size distribution of all silver halide grains is 20% or less, a signal having at least two peaks is present within a diffraction angle range of less than 1.5 degree at a maximum peak height× 0.13 of a (420) X-ray diffraction signal obtained using the $K_\alpha$ line of Cu, and a peak interval thereof is 0.1 degree or more in terms of diffraction angle.

In a preferred embodiment, the silver halide photographic emulsion of the invention contains tabular silver halide grains having an aspect ratio of 5 or more in an amount of 70% or more of the total projected area of all grains.

In another preferred embodiment, the variation coefficient of the grain size distribution of all silver halide grains is 10% or less.

The present invention also provides a silver halide photographic light-sensitive material comprising at least one silver halide emulsion layer on a support, wherein at least one silver halide emulsion layer contains the silver halide emulsion of the invention.

In one embodiment of the light-sensitive material, a silver halide emulsion layer contains a polymer represented by Formula (I) or Formula (II):

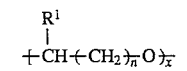

Formula (I)

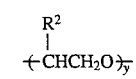

Formula (II)

where in formula (I), $R^1$ represents a hydrogen atom, an alkyl group having 1 to 10 carbon atoms, or an aryl group having 6 to 10 carbon atoms, and n represents an integer of 1 to 10, provided when n=1, $R^1$ may not be a hydrogen atom; and in formula (II), $R^2$ represents a hydrogen atom or a lower alkyl group substituted with a hydrophilic group and having 4 or less carbon atoms, and each of x and y represents the number of repetition (average polymerization degree) of each unit, x being 2 to 1000, and y being 1 to 1000.

DETAILED DESCRIPTION OF THE PREFERRED EMBODIMENTS

Figure 1:
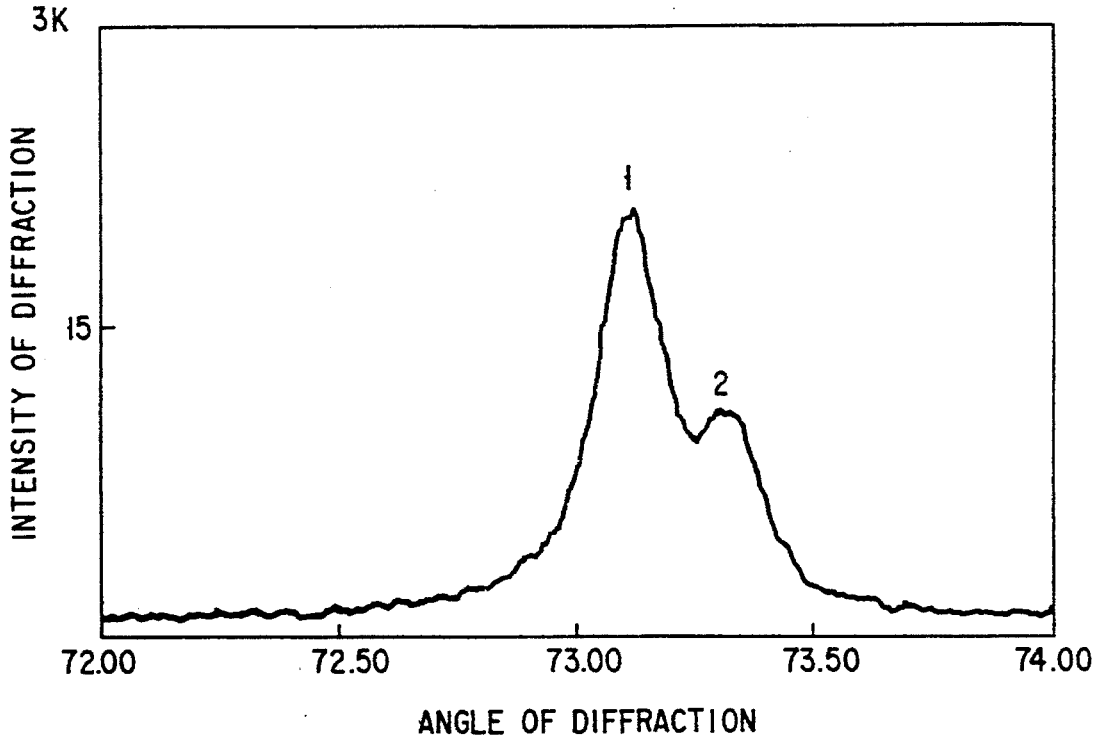
FIG. 1 is a graph showing an X-ray diffraction signal of emulsion A described below.

In the present invention, a tabular silver halide grain (to be called a "tabular grain") refers to a silver halide grain having two opposing parallel major faces, and in which the equivalent-circle diameter of the major face (diameter of the circle whose area is equal to the projected area of the major face) is at least twice as large as the distance between the major faces (that is, thickness of the grain).

The term "aspect ratio" of the present invention is defined as a value obtained by dividing the equivalent-circular diameter of individual grain obtained by a method, which will be described later, by the thickness of the grain.

The average aspect ratio of the emulsion containing tabular grains according to the present invention is 2 or more, preferably 4 or more, and more preferably 5 or more.

The average aspect ratio can be obtained by averaging the grain diameter/grain thickness ratios of all tabular grains. As a simple technique, the average aspect ratio can be obtained as a ratio of the average diameter of all tabular grains to the average thickness thereof.

The emulsion of the present invention is characterized by containing tabular grains having an aspect ratio of 2 or more in an amount of 70% or more of the total projected area of all silver halide grains, preferably in amount of 80% or more, more preferably 90% or more of the total projected area.

The (equivalent-circle) diameter of each tabular grain of the present invention is 0.2 to 5.0 μm, preferably 0.3 to 4.0 μm, and more preferably, 0.3 to 3.0 μm.

The thickness of each tabular grain is 0.5 μm or less, preferably 0.05 to 0.5 μm, and more preferably, 0.08 to 0.3 μm.

The diameter and thickness of each grain of the present invention can be measured from the electron micrographs of the grains as in the method disclosed in U.S. Pat. No. 4,434,226.

In the tabular grains of the present invention, the value obtained by dividing the average circular-equivalent diameter by the square of the average thickness (the value defined as $ECD/t^2$ in JP-A-3-135335) is 5 or more, preferably 10 or more, and more preferably 25 or more, in an amount of 70% or more of the total projected area of all silver halide grains.

The tabular grains of the present invention are characterized by their monodispersity in which a variation coefficient of the grain size distribution is 20% or less. The variation coefficient is expressed by the value obtained by dividing the variation of the grain sizes (standard deviation), which is calculated from the equivalent-circle diameter of the projected area of the tabular grains and the thickness, by the average grain size, and multiplying the quotient by 100. The grain size, R (μm), can be calculated from the equivalent-circle diameter, r (μm), of the projected area and the thickness, d (μm), in accordance with the following equation:

$$R=\{(3/2)r^2d\}^{1/3}$$

A silver halide emulsion consisting of silver halide grains having a uniform shape and a small grain size variation exhibits a nearly normal grain size distribution, and therefore the standard deviation thereof can be easily obtained. The variation coefficient of the grain size distribution of the tabular grains of the present invention is 20% or less, preferably 10% or less, and more preferably 8% or less.

The structure of the halogen composition of each grain can be observed by combining the X-ray diffraction method, the EPMA (also known as XMA) method (of detecting silver halide composition by scanning silver halide grain with electron beam), the ESCA (also known as XPS) method (spectroscopic method for photoelectrons emitted from grain surface when irradiated with X ray), and the like.

The tabular grain of the present invention is characterized by the presence of a signal having at least two peaks within a diffraction angle range of less than 1.5 degrees at the maximum peak height×0.13 of the (420) X-ray diffraction signal obtained using the $K_\alpha$ line of Cu, and having a peak interval of 0.1 degree or more in terms of angle of diffraction.

An example of the method of measuring an X-ray diffraction is disclosed, for example, in the section of "X-ray analysis" of "Lecture of Basic Analytical Chemistry 24" (Kyoritsu Shuppan, Japan).

The (420) X-ray diffraction signal obtained using the $K_\alpha$ line of Cu can be observed at diffraction angle (2θ) of 71 to 74 degrees. The "presence of a signal" means that there is present a peak having a signal intensity corresponding to the maximum peak height multiplied by 0.13, or a higher signal intensity (diffraction strength). Note that a signal having an intensity less than 4% of maximum peak height, or a noise is not counted as a peak. The presence of at least two peaks means that there is a distinguishable trough between peaks, and a peak shoulder signal is not counted as a peak.

In the tabular grains of the present invention, a signal having at least two peaks is present within a diffraction angle of less than 1.5 degrees at the highest peak height×0.13 of the X-ray diffraction signal, but the signal is preferably present within a diffraction angle range of less than 1.4 degrees.

The number of peaks is preferably two or three, particularly 2. In the invention, the peak interval is 0.1 degree or more in terms of diffraction angle, preferably 0.1 degree or more but less than 1.3 degree, and more preferably 0.1 degree or more but less than 0.27 degree.

A dislocation is preferably introduced into each tabular grain of the present invention as those grains disclosed in JP-A-53-220238, JP-A-1-201649 and JP-A-4-190226.

Preferably, grains each having 10 or more dislocation lines are present in amount of 70% or more (in number) of all silver halide grains. More preferably, grains each having 10 or more dislocation lines are present in amount of 80% in number or more, and more preferably, 90% in number or more of all silver halide grains.

In the tabular grains of the present invention the relative standard deviation of the silver iodide content distribution of individual grains is preferably 30% or less, more preferably 20% or less.

The silver iodide contents of individual emulsion grains can be measured by analyzing the composition of each grain by use of, e.g., an X-ray microanalyzer. The "relative standard deviation of the silver iodide contents of individual grains" can be obtained by measuring the silver iodide contents of at least 100 emulsion grains by using, e.g., an X-ray microanalyzer, dividing the standard deviation of the silver iodide contents measured by a mean silver iodide content, and multiplying the quotient by 100. A specific method of measuring the silver iodide contents of individual emulsion grains is described in, e.g., EP147,868A.

In the present invention, grains whose silver iodide contents are measured to obtain the relative standard deviation of their silver iodide content distribution are large-size tabular silver halide grains defined as follows. That is, when all grains of an emulsion are arranged in decreasing order of a projected area and their projected areas are added, the "large-size tabular silver halide grains" are grains obtained when the sum reaches 50% of the total projected area. To actually obtain the relative standard deviation, it is necessary to check whether each of 500 or more grains extracted at random is the large-size tabular silver halide grain as a control, and to measure the silver iodide contents of the 500 or more grains which are extracted at random from grains as a control. If, therefore, fine grains with extremely different silver iodide contents are present, these silver iodide contents are neglected in calculating the relative standard deviation.

If the relative standard deviation of the silver iodide content distribution of individual grains is large, adequate points of chemical sensitization (conditions of chemical sensitization adequate for individual grains) are different between the grains. This makes it impossible to take advantage of performance of all emulsion grains.

Although grains have or do not have a correlation between a silver iodide content Yi (mol %) and a grain size Xi (μm), it is possible to use both of them.

A method of manufacturing the tabular grains of the present invention will be described below.

As the tabular grain manufacturing method, it is possible to use a given combination of methods known to those skilled in the art.

The silver halide emulsion of the present invention can be manufactured by either of the following methods.

(1) Nucleation→ripening (2) Nucleation→ripening→growth

Steps of nucleation, ripening, and growth, therefore, as the basic steps of both the methods will be described below.

1. Nucleation

Nucleation is performed at a pBr of 1.0 to 2.5 by using gelatin as a dispersing medium. The pBr can be controlled by a silver potential in any of the nucleation, ripening, and growth steps.

A low-molecular-weight gelatin can be used as the gelatin. The average molecular weight of the gelatin is preferably 60,000 or less, and more preferably 1,000 to 40,000. If an average molecular weight is greater than 60,000, the ratio of tabular grains in all silver halide grains tends to decrease.

The low-molecular-weight gelatin can be used in an amount of 50% by weight or more, preferably 70% by weight or more of the dispersing medium.

The concentration of the dispersing medium can be 0.05 to 10% by weight.

Alkali-processed gelatin is commonly used as the gelatin, but it is also possible to use acid-processed gelatin or modified gelatin such as phthalated gelatin.

In addition, one or both of an aqueous $AgNO_3$ solution and an aqueous alkali halide solution which are added during nucleation preferably contain gelatin. The low-molecular-weight gelatin described above can be preferably used as this gelatin. As in the above case, the low molecular weight gelatin can be used in an amount of preferably 50 wt % or more, more preferably 70 wt % or more of the dispersing medium.

The concentration of the dispersing medium in this case is preferably 0.05 to 5 wt %, and more preferably 0.3 to 2.0 wt %.

It is assumed that the effect that the low molecular weight gelatin increase the ratio of the tabular grains is obtained by avoiding a nonuniform gelatin concentration near an addition port of the aqueous $AgNO_3$ solution and the aqueous halide salt solution, thereby preventing formation of multi-twinning grains.

A frequency at which twin planes are formed during nucleation depends on various supersaturation factors (e.g., a temperature during nucleation, a gelatin concentration, the type of gelatin, the molecular weight of gelatin, the addition rates of an aqueous silver salt solution and an aqueous alkali halide solution, a $Br^-$ concentration, the rotating speed of stirring, the $I^-$ content of an aqueous alkali halide solution to be added, the amount of a silver halide solvent, a pH, salt concentrations (e.g., the concentrations of $KNO_3$ and NaNO3), and the concentrations of an emulsion stabilizer, an antifoggant, and a sensitizing dye). This dependency is shown in FIGURE of our JP-A-63-092942.

If these supersaturation factors are increased during nucleation in a method in which the nucleation is performed at a low temperature (25° to 30° C.) and high supersaturation growth is immediately performed at the low temperature without performing ripening, principal grains formed change in an order of a) octahedral regular grains→b) grains having a single twin plane→c) grains (object) having two parallel twin planes→d) grains having nonparallel twin planes→e) grains having three or more twin planes.

In the present invention, therefore, it is favorable to perform nucleation such that the formation probability of the grains c) is increased as high as possible within a range over which the formation ratio of the grains d) or e) is not increased.

That is, the above various supersaturation factors are adjusted such that the presence ratio of the grains c) falls within a range defined by the present invention in a silver halide emulsion finally obtained by the grain formation method of the present invention while the dependency shown in the figure of JP-A-63-092942 mentioned earlier is checked. More specifically, the conditions of the above supersaturation factors during nucleation are adjusted while replica images of finally produced silver halide grains are observed by a transmission electron microscope.

The nucleation for tabular grains having a silver iodide content of 7 mol % or more in the central regions may be effected by referring to JP-A-63-092942.

When tabular grains finally obtained by adjusting these various factors were observed, it was found that the mixing ratio of nontabular grains was low in the tabular grains formed by performing nucleation under the above conditions compared to grains obtained when a regular photographic gelatin with an average molecular weight of 100,000 was used as a dispersing medium. As for the shapes of grains, the ratio of hexagonal tabular grains described in JP-A-63-151618 is high. In grains according to the Example of French Patent 2,534,036, the ratio of triangular tabular grains (having three parallel twin planes) is high. The reason for this is assumed that nucleation was performed in a high super-saturation condition.

Other preferred conditions during nucleation according to the present invention are as follows.

Although the temperature can be 5° to 60° C., it is preferably 5° to 48° C. in forming fine tabular grains with a mean grain size of 0.5 μm or less. The iodide ion content in the solution added beforehand is preferably 0.03 mol/liter or less. The addition rate of $AgNO_3$ is preferably 0.5 to 30 g/min per liter of an aqueous reaction solution.

As to the composition of an alkali halide solution to be added, the iodide ion content with respect to the bromide ion content is preferably the solid solution limit or less of AgBrI to be formed, more preferably 20 mol % or less.

In the present invention, polyalkylene oxide block copolymers described in U.S. Pat. Nos. 5,147,771, 5,147,772, and 5,147,773 and EP513,723A are preferably used in order to increase the monodispersity.

The polymer is used in an amount of, preferably, 0.1 to 50% by weight, more preferably 0.2 to 20 % by weight of Ag in the aqueous $AgNO_3$ solution to be added during the nucleation.

Of these polymers, a particularly useful one is a polymer having in its molecule a block polymer component consisting of a hydrophobic polyalkylene oxide represented by Formula (I) shown before and a block polymer component consisting of a hydrophilic polyalkylene oxide represented by Formula (II) shown before.

In Formula (I) shown previously, $R^1$ represents a hydrogen atom, an alkyl group having 1 to 10 carbon atoms (e.g., methyl, chloromethyl, ethyl, and n-butyl), or an aryl group having 6 to 10 carbon atoms (e.g., phenyl and naphthyl), and n represents an integer of 1 to 10. If n=1, $R^1$ is not a hydrogen atom.

In Formula (II) shown previously, $R^2$ represents a hydrogen atom or a lower alkyl group which is substituted with a hydrophilic group (e.g., hydroxy and carboxyl) and has 4 or less carbon atoms (e.g., hydroxymethyl and carboxymethyl).

Each of x and y represents the repeating number (number-average polymerization degree) of each unit.

Although favorable ranges of x and y vary depending on the structure of a polymer, x is preferably 2 to 1,000, and more preferably 3 to 500, and y is preferably 1 to 1,000, and more preferably 2 to 400.

The ratio of the component represented by Formula (I) to the component represented by Formula (II) in the block polymer can vary depending on the hydrophilic or hydrophobic nature of each unit and the type of an emulsion. However, the ratio roughly ranges between 4:96 and 96:4 as a weight ratio.

A hydrophobic polyalkylene oxide represented by Formula (I) is particularly preferably polypropylene oxide ($R^1$= methyl, n=1). A hydrophilic polyalkylene oxide represented by Formula (II) is preferably polyethylene oxide ($R^2$= hydrogen atom) or polyglycerol ($R^2$=$CH_2OH$), and particularly preferably polyethylene oxide.

As the polymer having the above block copolymer components in its molecule, a compound having, as its block copolymer components, polypropylene oxide-polyethylene oxide as representative components will be described in more detail below.

Representative examples of the polymer used in the present invention are those represented by Formulas (III) to (X) below.

ylmethyl, N-methyl-N-ethylaminoethyl, and N,N-diethylaminoethyl.

In Formulas (VII) to (X), L represents a trivalent or tetravalent linking group. Examples of L are presented below, but L is not limited to these examples.

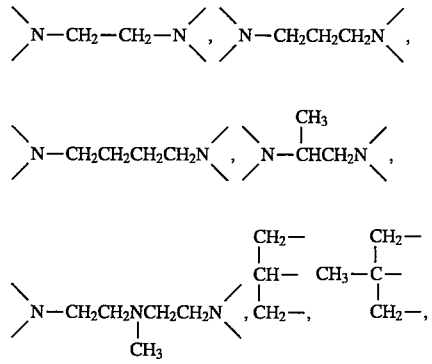

Formula (III)

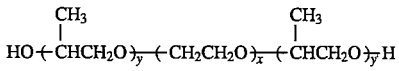

Formula (IV)

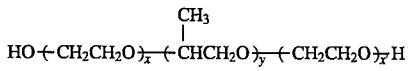

Formula (V)

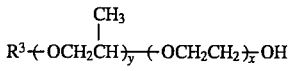

Formula (VI)

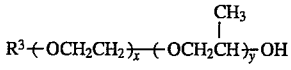

Formula (VII)

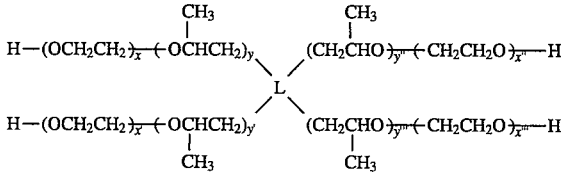

Formula (VIII)

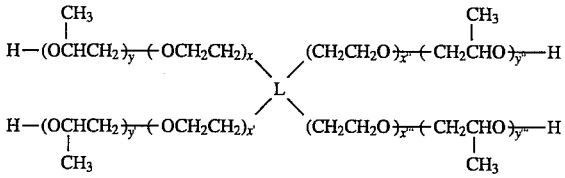

Formula (IX)

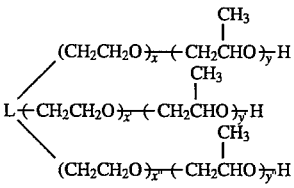

Formula (X)

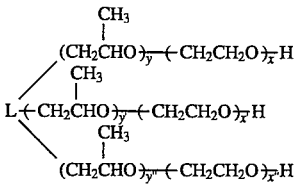

In Formulas (III) to (X), each of x, x', x", x'", y, y', y", and y " represents the repeating number of each unit, and their preferable ranges are identical with those of x and y of Formulas (I) and (II). $R^3$ represents a monovalent group. More specifically, $R^3$ represents a hydrogen atom, a substituted or unsubstituted alkyl group or aryl group, preferably a substituted or unsubstituted lower alkyl group (having 6 or less carbon atoms). Examples of $R^3$ are methyl, ethyl, n-propyl, isopropyl, t-butyl, chloromethyl, methoxycarbon- -continued

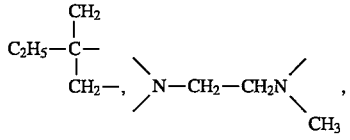

-continued

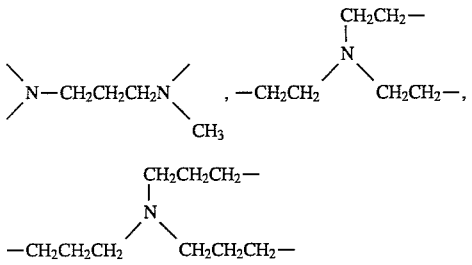

Examples of the polymer having the block polymer components in its molecule for use in the present invention are listed in Tables 1 and 2 below, but the present invention is not limited to these examples.

TABLE 1

| Compound No. | Type of polymer (number of formula) | $R_3$ | x | y |
|---|---|---|---|---|
| P-1 | (III) | | 7 | 25 |
| P-2 | (III) | | 5 | 15 |
| P-3 | (III) | | 27 | 15 |
| P-4 | (III) | | 125 | 23 |
| P-5 | (III) | | 42 | 23 |
| P-6 | (III) | | 16 | 23 |
| P-7 | (IV) | | 10 | 15 |
| P-8 | (IV) | | 40 | 15 |
| P-9 | (IV) | | 2 | 32 |
| P-10 | (IV) | | 9 | 32 |
| P-11 | (IV) | | 20 | 32 |
| P-12 | (IV) | | 135 | 50 |
| P-13 | (IV) | | 14 | 50 |
| P-14 | (V) | $CH_3$— | 35 | 30 |
| P-15 | (V) | $C_3H_7$— | 25 | 50 |
| P-16 | (V) | $C_2H_5$— | 20 | 70 |
| P-17 | (VI) | $CH_3$— | 40 | 25 |
| P-18 | (VI) | $(CH_3)_2CH$— | 50 | 30 |

y' of an exemplified compound represented by Formula (II) has the same value as y.
x' of an exemplified compound represented by Formula (III) has the same value as x.

TABLE 2

| Compound No. | Type of polymer (number of formula) | L | x | y |
|---|---|---|---|---|
| P - 19 | (VII) | 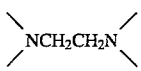 | 2 | 15 |
| P - 20 | (VII) | | 16 | 17 |
| P - 21 | (VII) | | 4 | 32 |
| P - 22 | (VII) | | 140 | 32 |
| P - 23 | (VIII) | | 18 | 20 |
| P - 24 | (VIII) | | 4 | 33 |
| P - 25 | (VIII) | | 108 | 20 |
| P - 26 | (VII) | 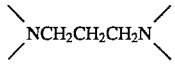 | 15 | 20 |
| P - 27 | (IX) | 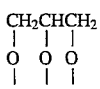 | 10 | 25 |
| P - 28 | (IX) | | 40 | 20 |

TABLE 2-continued

| Compound No. | Type of polymer (number of formula) | L | x | y |
|---|---|---|---|---|
| P - 29 | (X) | 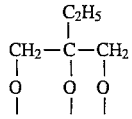 | 15 | 17 |
| P - 30 | (X) | | 85 | 33 |
| P - 31 | (IX) |  | 16 | 23 |
| P - 32 | (X) | | 25 | 20 |
| P - 33 | (X) | | 55 | 30 |

Each of x', x", and x"' and each of y', y", and y"' in each formula take the same values as x and y of each corresponding exemplified compound.

Examples and general description of the polymer used in the present invention, and examples of preparation of silver halide emulsions using the polymer of this type are given in, e.g., European Patents 513,722, 513,723, 513,724, 513,725, 513,742, 513,743, and 518,066.

The concentration of an unrelated salt (a salt which does not directly participate in formation of a silver halide) in a reaction solution is preferably 0 to 1 mol/liter. The pH of the reaction solution can be 2 to 10, but it is preferably 8.0 to 10 if reduction-sensitized silver nuclei are to be introduced. The concentration of a silver halide solvent in the reaction solution is preferably $3\times10^{-1}$ mol per liter. The silver halide solvent will be described later. 2. Ripening In the nucleation (item 1 above), although fine tabular grain nuclei are formed, a large number of other fine grains (especially octahedral and single-twinned grains) are formed simultaneously. It is therefore required to vanish grains other than tabular grain nuclei before a growth step to be described next is started, thereby obtaining nuclei having a shape as a tabular grain and a high monodispersity. Ostwald ripening is performed subsequently to the nucleation in order to make this possible.

Although the method described in JP-A-63-151618 is usable as this ripening method, the following method is particularly effective.

After nucleation, a portion of the resultant emulsion is extracted as a seed crystal and added with an aqueous gelatin solution, or, an aqueous gelation solution is simply added after nucleation, thereby controlling the pBr and the gelation concentration. In this case, the pBr is preferably low (1.4 to 2.0), and the gelation concentration is 1 to 10% by weight. The gelatin is preferably one having an average molecular weight of 80,000 to 300,000, normally 100,000, which is often used in the field of photography.

Subsequently, when the temperature is raised to cause first ripening, tabular grains grow, and nontabular grains disappear. Then, an aqueous $AgNO_3$ solution is added to adjust the pBr of the solution to a higher value (pBr=1.7 to 2.6), and second ripening is conducted by adding a silver halide solvent. The concentration of the silver halide solvent in this case is preferably $1\times10^{-4}$ to $2\times10^{-1}$ mol/liter. Ripening is performed in this manner to obtain nearly 100% tabular grains.

In this ripening step, as in the above nucleation step, the polyalkylene oxide block copolymer described above can be preferably used.

In the first ripening at a low pBr, basically Ostwald ripening between twinned grains having troughs and grains having no troughs takes place. In the next second ripening using a silver halide solvent at a high pBr, Ostwald ripening occurs between the major faces of tabular grains and the spherical surfaces of nontabular grains, resulting in almost 100% tabular grains.

This second ripening has an effect of vanishing nontabular grains that cannot be vanished in the first ripening, and an effect of obtaining a uniform thickness of seed crystals of tabular grains. When ripening is done at a low pAg by using a silver halide solvent, growth is caused in the direction of thickness of tabular grains, and this increases the thicknesses of the grains. If the grain thicknesses are nonuniform, growth rates in the lateral direction become nonuniform in the crystal growth performed next. This phenomenon is significant especially during crystal growth under a low pBr (1.4 to 2.0) condition, and hence is unpreferred particularly in such a case.

Since the ripening proceeds slowly at low temperatures, it is performed at 40° C. to 80° C., preferably 50° C. to 80° C. in a practical point of view.

The gelatin concentration is 0.05 to 10% by weight, preferably 1.0 to 5.0% by weight. In an emulsion at the end of this ripening step, 95% or more of the total projected area of all silver halide grains are accounted for by tabular grains having two parallel twin planes. Normally, these tabular grains are hexagonal tabular grains in which the corners of a hexagon are slightly rounded, or circular tabular grains.

When this ripening step is finished, the resultant emulsion may be washed with water by a regular washing process and used as the tabular grains of the present invention.

When the ripening is finished, however, a crystal growth step is normally started in order to grow the crystal to have a desired size.

After the ripening, the silver halide solvent is removed as follows if it is unnecessary in the next growth step.

(1) An emulsion is washed with water.

As the emulsion washing process, it is possible to use conventional methods, such as (i) a noodle washing method, (ii) a washing method of causing precipitation by adding a precipitating agent, (iii) a precipitation washing method using a modified gelatin such as gelatin phthalate, and (iv) an ultrafiltration method (described in detail in G. F. Duffin, "Photographic Emulsion Chemistry," Focal Press, London, 1966 and references to be presented later).

(2) In the case of an alkaline silver halide solvent such as $NH_3$, an acid such as $HNO_3$ having a large solubility product with respect to $Ag^+$ is added to neutralize the silver halide solvent, thereby rendering the solvent ineffective.

(3) In the case of a thioether-based silver halide solvent, an oxidizing agent such as H202 is added to render the solvent ineffective as described in JP-A-60-136736.

3. Growth

In a crystal growth period subsequent to the ripening step, the pBr is preferably kept at 1.4 to 3.0. It is also preferable to set the addition rates of $Ag^+$ and halogen ions in the crystal growth period at 20% to 100%, preferably 30% to 100% of a crystal critical growth rate.

That is, as the pBr and the supersaturation degree are increased in a growth environment during the crystal growth period, tabular grains become more monodisperse with growth. However, on a high-pBr side (pBr 2 to 3.0, or in a tetradecahedral crystal or cubic crystal formation region to be described later), monodisperse tabular grains with a low aspect ratio are obtained since growth also occurs in the direction of thickness.

Tabular grains with a high aspect ratio can be obtained when growth is performed on a low-pBr side (pBr 1.4 to 2.0, or in a formation region of a {111}-face crystal such as an octahedral crystal to be described later) and at a high supersaturation.

In this case, the addition rates of silver ions and halogen ions are increased with the crystal growth. As a method of increasing the addition rates, it is possible to increase the addition rates (flow rates) of an aqueous silver salt solution and an aqueous halogen salt solution with fixed concentrations, or to increase the concentrations of the aqueous silver salt solution and the aqueous halogen salt solution, as described in JP-B-48-36890 ("JP-B" means Examined Published Japanese Patent Application) and JP-B-52-16364. It is also possible to increase the addition rate of a very-fine grain emulsion with a grain size of 0.10 μm or less which is prepared beforehand. A combination of these methods is also possible. The addition rates of silver ions and halogen ions can be increased either intermittently or continuously.

The details of the addition rate increasing methods and stirring methods are described in JP-A-55-142329, Japanese Patent Application No. 61-299155, U.S. Pat. No. 3,650,757, and British Patent 1,335,925.

Generally, as the pBr of the growth environment is lowered and the supersaturation degree is decreased, the grain size distribution of resultant grains is broadened.

The use of the above-mentioned polyalkylene oxide block copolymer in this growth step is favorable to obtain monodispersity.

It is basically possible to prepare the tabular grains of the present invention through the steps of nucleation, ripening, and growth described above.

The halogen composition of a silver halide to be stacked on a nucleus during growth is not particularly limited. In many cases, the silver halide is AgBr or AgBrClI (a silver iodide content is 0 to a solid solution limit, and a Cl content is 0 to 50 mol %).

To obtain a gradually increasing or decreasing intragrain iodide distribution, it is possible to gradually increase or decrease the composition ratio of iodide in a halide to be added with crystal growth. To obtain a sharp distribution, it is possible to abruptly increase or decrease the composition ratio of iodide in a halide to be added with crystal growth.

As a method of supplying iodide ions during this crystal growth period, it is possible to use a method of adding a fine-grain AgI (grain size 0.1 μm or less, preferably 0.06 μm or less) emulsion prepared beforehand. This method also can be used in combination with a method of supplying iodide ions by using an aqueous alkali halide solution. The combination of these methods is particularly preferred because fine-grain AgI dissolves to uniformly supply $I^-$.

In the present invention, a reduction sensitization nucleus is preferably contained in the silver halide grain, and the pH of a solution during growth is preferably 8.0 to 9.5 in this point of view.

A silver halide solvent (to be described later) can be used to promote growth during the crystal growth period. The concentration of the silver halide solvent in that case is preferably $3.0\times10^{-1}$ mol/liter or less.

The above method makes it possible to prepare tabular grains in which at least 70% of the total projected area are occupied by tabular grains with an aspect ratio of 2 or more, and the variation coefficient of the grain size distribution of these grains which account for 70% or more is 20% or less.

A silver halide solvent is useful for the purpose of promoting ripening, as mentioned before. As an example, it is known to make an excess of halogen ions exist in a reactor vessel in order to promote ripening. It is obvious from this fact that ripening can be encouraged only by introducing a halide salt solution into a reactor vessel. Other ripening agents than halogen ions can also be used. The total amount of these ripening agents can be mixed in a dispersing medium placed in a reactor vessel before addition of silver and a halide salt or can be introduced to the reactor vessel simultaneously with addition of one or more of a halide salt, a silver salt, and a deflocculant. Alternatively, ripening agents can be independently added in the step of adding a halide salt and a silver salt.

Examples of the ripening agent other than halogen ions are ammonia, an amine compound, a thiocyanate, e.g., an alkali metal thiocyanate, particularly sodium thiocyanate and potassium thiocyanate, and ammonium thiocyanate. The use of a thiocyanate ripening agent is disclosed in U.S. Pat. Nos. 2,222,264, 2,448,534, and 3,320,069. It is also possible to use regularly used thioether ripening agents such as described in U.S. Pat. Nos. 3,271,157, 3,574,628, and 3,737,313. Thione compounds disclosed in JP-A-53-82408 and JP-A-53-144319 also are usable.

The diffraction line width, the number of the peaks, and the peak interval of the (420)X-ray diffraction signal can be controlled by changing the halogen composition of the tabular silver halide grains and the halogen composition structure within the grains.

When the tabular silver halide emulsion is formed of silver bromoiodide, the tabular silver halide emulsion having the X-ray diffraction signal defined herein can be obtained by controlling the silver halide content, and the iodide content distribution within the grains. More specifically, with a tabular silver halide emulsion having a silver iodide content of 8 mol % or less, preferably 5 mol % or less, more preferably 3 mol % or less, in order to form a phase which makes different the inner-grain silver iodide content, the addition amount of the iodide ions added during nucleation, ripening or growing stage of the emulsion can be controlled to form the emulsion having the X-ray diffraction signal as defined herein. The addition rate of the iodide ions is preferably rapid, and the grain preferably has the maximum silver iodide content within it.

The properties of silver halide grains can be controlled by making various compounds exist in a silver halide precipitation formation step. Such compounds can be made exist initially in a reactor vessel or added together with one or more salts in accordance with conventional methods. It is possible to control the characteristics of a silver halide by allowing copper, iridium, lead, bismuth, cadmium, zinc, (e.g., chalcogen compounds such as of sulfur, selenium, and tellurium), gold, and compounds of Group VII noble metals to exist in the silver halide precipitation formation step, as described in U.S. Pat. Nos. 2,448,060, 2,628,167, 3,737,313, and 3,772,031, and Research Disclosure Vol. 134, June 1975, 13452. The interiors of grains of a silver halide emulsion can be reduction-sensitized during the precipitation formation step as described in JP-B-5-1410 and Moisar et al., Journal of Photographic Science, Vol. 25, 1977, pages 19 to 27.

The tabular grain used in the present invention can be junctioned with a silver halide with a different composition through epitaxial junction, or junctioned with a compound other than a silver halide, such as silver rhodanate or lead oxide. These emulsion grains are disclosed in U.S. Pat. Nos. 4,094,684, 4,142,900, and 4,459,353, British Patent 2,038,792, U.S. Pat. Nos. 4,349,622, 4,395,478, 4,433,501, 4,463,087, 3,656,962, and 3,852,367, and JP-A-59-162540.

The tabular grains of the present invention are normally, chemically sensitized.

The chemical sensitization can be performed by using an active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at a pAg of 5 to 10, a pH of 5 to 8, and a temperature of 30 to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. The chemical sensitization is optimally performed in the presence of a gold compound and a thiocyanate compound, or in the presence of a sulfur-containing compound described in U.S. Pat. Nos. 3,857,711, 4,266,018, and 4,054,457 or a sulfur-containing compound such as hypo, a thiourea-abased compound, or a rhodanine-based compound. The chemical sensitization can also be performed in the presence of a chemical sensitization aid. Examples of the chemical sensitization aid are azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143. In addition to or in place of the chemical sensitization, reduction sensitization can be performed by using, e.g., hydrogen, as described in U.S. Pat. Nos. 3,891,446 and 3,984,249. It is also possible to perform the reduction sensitization by using stannous chloride, thiourea dioxide, polyamine, and a reducing agent of this sort, as described in U.S. Pat. Nos. 2,518,698, 2,743,182, and 2,743,183, or through a low-pAg (e.g., lower than 5) and/or high-pH (e.g., greater than 8) processing. Color sensitivity also can be improved by chemical sensitization methods described in U.S. Pat. Nos. 3,917,485 and 3,966,476.

It is also possible to apply a sensitizing method using an oxidizer described in JP-A-61-3134 or JP-A-61-3136.

An emulsion composed of the tabular grains of the present invention can be used together with an emulsion consisting of silver halide grains (to be referred to as nontabular grains hereinafter) subjected to normal chemical sensitization in the same silver halide emulsion layer. Especially in the case of a color photographic light-sensitive material, it is possible to use a tabular grain emulsion and a nontabular grain emulsion in different emulsion layers and/or the same emulsion layer. A light-sensitive emulsion other than the tabular monodisperse emulsion includes a tabular polydisperse emulsion having an average aspect ration of 2 or more, a non-tabular twinned crystal polydisperse or monodisperse emulsion, or a regular monodisperse emulsion. The regular monodisperse emulsion is usually composed of cubic, octahedral, dodecahedral, or tetradecahedral grains or a mixture of these crystal habits. The corners may or may not be rounded. Further, the plane may no be flat, and may have irregularities or projections. Crystal portion having a different halogen composition may be epitaxially joined to the plane, edge or apex, or a compound other than silver halide, such as silver rhodanide or lead oxide, may be joined.

All the emulsions used in the present invention preferably have a structure resulting from the difference of the halogen composition within the grains. The difference in the composition is preferably due to the difference in the AgI content. It is preferred that the maximum value of AgI is present within the grain. The maximum value mentioned may be present in number of 1 or more. The AgI content of the AgI-rich phase is from 2 or more times the average AgI content in the emulsion in which the grains in question are contained, up to AgI 100%. Further, each grain preferably has 10 or more dislocation lines within it. The dislocation lines may be present uniformly throughout the grain, may be localized at one or more phases which form the structure, or may be concentrated at the outermost phase or a portion thereof.

The latent image formation site of the light-sensitive emulsion may be mainly present either on the surface or in the interior, or both. However, the emulsion must be a negative emulsion. The internal latent image type emulsion may be of the core/shell type disclosed in JP-A-63-264740. The preparation of the core/shell type internal latent image emulsion is disclosed in JP-A-59-133542. The thickness of the shell of this emulsion varies depending on, for example, development conditions, but is preferably 3 to 40 nm, more preferably 5 to 20 nm.

Each light-sensitive emulsion layer is formed of one or more emulsions. In the case of mixing a plurality of tabular emulsions, it is preferred that the average aspect ration of a lower-speed emulsion is larger than the average aspect ratio of a lower-speed emulsion. In addition, it is preferred that the silver iodide content of a higher-speed emulsion is less than that of a lower-speed emulsion. A mixture of a tabular emulsion with a non-tabular twinned crystal emulsion or a regular emulsion can be preferably used. It is also preferred that a plurality of regular emulsions be mixed together, particularly in the case of the average grain size of 0.4 μm or less.

The light-sensitive material having the above-mentioned construction of emulsion can exhibit prominent advantages, particularly when formulated into a color reversal photographic light-sensitive material.

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in west German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

To improve the color reproduction, a donor layer (CL) of an interlayer effect can be arranged directly adjacent to, or close to, a main light-sensitive layer such as BL, GL or RL. The donor layer has a spectral sensitivity distribution which is different from that of the main light-sensitive layer. Donor layers of this type are disclosed in U.S. Pat. No. 4,663,271, U.S. Pat. No. 4,705,744, U.S. Pat. No. 4,707,436, JP-A-62-160448, and JP-A-63-89850.

As described above, various layer configurations and arrangements can be selected in accordance with the application of the light-sensitive material.

The silver halide photographic emulsion which can be used in the present invention can be prepared by methods described in, for example, Research Disclosure (RD) No. 17643 (December 1978), pp. 22 to 23, "I. Emulsion preparation and types", RD No. 18716 (November 1979), page 648, and RD No. 307105 (November 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions can be prepared by methods described in, for example, U.S. Pat. Nos. 3,574,628 and 3,655,394, and British Patent 1,413,748 are also preferred.

Tabular grains can be easily prepared by methods described in, e.g., Gutoff, "Photographic Science and Engineering", Vol. 14, PP. 248 to 257 (1970); U.S. Pat. Nos. 4,434,226; 4,414,310; 4,433,048 and 4,499,520, and British Patent 2,112,157.

A silver halide emulsion layer is normally subjected to physical ripening, chemical ripening, and spectral sensitization steps before it is used. Additives for use in these steps are described in RD Nos. 17,643; 18,716 and 307,105 and they are summarized in the table represented later.

Surface-fogged silver halide grains described in U.S. Pat. No. 4,082,553, internally fogged silver halide grains described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed despite the presence of a non-exposed portion and exposed portion of the light-sensitive material. A method of preparing the internally fogged or surface-fogged silver halide grain is described in U.S. Pat. No. 4,626,498 or JP-A-59-214852.

The silver halides which form the core of the internally fogged or surface-fogged core/shell silver halide grains may be of the same halogen composition or different halogen compositions. Examples of the internally fogged or surface-fogged silver halide are silver chloride, silver bromochloride, silver bromoiodide, and silver bromochloroiodide. Although the grain size of these fogged silver halide grains is not particularly limited, an average grain size is preferably 0.01 to 0.75 μm, and most preferably, 0.05 to 0.6 μm. The grain shape is also not particularly limited, and may be a regular grain shape. Although the emulsion may be a polydisperse emulsion, it is preferably a monodisperse emulsion.

In the present invention, a non-light-sensitive fine-grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The unfogged fine-grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm. The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table:

| Additives | RD17643 | RD18716 | RD307105 |
|---|---|---|---|
| 1. Chemical sensitizers | page 23 | page 648, right column | page 866 |
| 2. Sensitivity-increasing agents | | page 648, right column | |
| 3. Spectral sensitizers, super-sensitizers | pp. 23–24 | page 648, right column to page 649, right column | pp. 866–868 |
| 4. Brighteners | page 24 | page 648, right column | page 868 |
| 5. Antifoggants, stabilizers | pp. 24–25 | page 649, right column | pp. 868–870 |
| 6. Light absorbent, filter dye, ultra-violet absorbents | pp. 25–26 | page 649, right column to page 650, left column | page 873 |
| 7. Stain-preventing agents | page 25, right column | page 650, left-right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. No. 4,411,987 or 4,435,503, which can react with formaldehyde and fix the same, is preferably added to the light-sensitive material.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-l-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889; 4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD NO. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

RD Nos. 11449 and 24241, and JP-A-61-201247, for example, disclose couplers which release bleaching accelerator. These couplers effectively serve to shorten the time of any process that involves bleaching. They are effective, particularly when added to light-sensitive material containing tabular silver halide grains. Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl)isophthalate, bis(1,1-di-ethylpropyl)phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glyceroltributyrate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxybenzoate, phenol, 4-chloro-3,5-dimethylphenol, 2-phenoxyethanol, and 2-(4-thiazolyl-)benzimidazole, which are described in JP-A-63-257747, JP-A-62-272248, and JP-A-1-80941.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloid layers at the side having emulsion layers is preferably 28 μm or less, more preferably, 23 μm or less, much more preferably, 18 μm or less, and most preferably, 16 μm or less. A film swell speed $T_{1/2}$ is preferably 30 seconds or less, and more preferably, 20 seconds or less. The film thickness means a film thickness measured under moisture conditioning at a temperature of 25° C. and a relative humidity of 55% (two days). The film swell speed $T_{1/2}$ can be measured in accordance with a known method in the art. For example, the film swell speed $T_{1/2}$ can be measured by using a swell-meter described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{1/2}$ is defined as a time required for reaching 1/2 of the saturated film thickness.

The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness−film thickness)/film thickness.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethyl, aniline, 3-methyl-4-amino-N-ethyl-N-β-methoxyethylaniline, and the sulfates, hydrochlorides and p-toluenesulfonates thereof. Of these compounds, 3-methyl-4-amino-N-ethyl-N-β-hydroxyethylaniline, and the sulfates thereof are preferred in particular. The above compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof. Processing solutions except for the color developer and processing steps of the color reversal light-sensitive material of the present invention will be described below.

Of the processing steps of the color reversal light-sensitive material of the present invention, those from black-and-white (B/W) development to color development are as follows.

1) B/W development-washing-reversal-color development
2) B/W development-washing-photo-reversal-color development
3) B/W development-washing-color development The washing in any of the processes 1) to 3) can be replaced with rinsing described in U.S. Pat. No. 4,804,616 in order to simplify the process and reduce the quantity of a waste liquor.

Steps after the color development will be described.

4) Color development-conditioning-bleaching-fixing-washing-stabilization
5) Color development-washing-bleaching-fixing-washing-stabilization
6) Color development-conditioning-bleaching-washing-fixing-washing-stabilization
7) Color development-washing-bleaching-washing-fixing-washing-stabilization
8) Color development-bleaching-fixing-washing-stabilization
9) Color development-bleaching-bleach-fixing-washing-stabilization
10) Color development-bleaching-bleach-fixing-fixing-washing-stabilization
11) Color development-bleaching-washing-fixing-washing-stabilization
12) Color development-conditioning-bleach-fixing-washing-stabilization
13) Color development-washing-bleach-fixing-washing-stabilization
14) Color development-bleach-fixing-washing-stabilization
15) Color development-fixing-bleach-fixing-washing-stabilization In the processes 4) to 15), the washing immediately before the stabilization can be omitted, and the last stabilization step need not be performed. One of the processes 1) to 3) and one of the processes 4) to 15) combine together to form a color reversal process.

Processing solutions used in the color reversal process of the present invention will be described below.

As a B/W developing solution for use in the present invention, it is possible to use developing agents known to those skilled in the art. Examples of the developing agent are dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and a heterocyclic compound described in U.S. Pat. No. 4,067,872, in which a 1,2,3,4-tetrahydroquinoline ring and an indolene ring are condensed. These developing agents can be used singly or in a combination of two or more types of them.

The B/W developing solution for use in the present invention can contain, if necessary, a preservative (e.g., a sulfite or a bisulfite), a buffering agent (e.g., a carbonate, boric acid, a borate salt, or an alkanolamine), an alkaline agent (e.g., a hydroxide or a carbonate salt), a solubilizing aid (e.g., polyethyleneglycols or their esters), a pH control agent (e.g., an organic acid such as acetic acid), a sensitizer (e.g., a quaternary ammonium salt), a development accelerator, a surfactant, an anti-foaming agent, a film hardener, and a viscosity-imparting agent.

It is necessary to add a compound acting as a silver halide solvent to the B/W developing solution used in the present invention. In general, however, a sulfite salt to be added as the preservative described above plays this role as a solvent. Examples of a sulfite and other usable silver halide solvents are KSCN, NaSCN, $K_2SO_3$, $Na_2SO_3$, $K_2S_2O_5$, $Na_2S_2O_5$, $K_2S_2O_3$, and $Na_2S_2O_3$.

Although the pH of a developing solution thus prepared is so selected as to yield desired density and contrast, it falls within the range of about 8.5 to about 11.5.

To perform sensitization using such a B/W developing solution, a processing time is prolonged a maximum of about three times that of standard processing. In this case, raising the processing temperature can shorten the time prolonged for sensitization.

The pH of the color and black-and-white developers is generally 9 to 12. Although the quantity of a replenisher of these developers depends on a color photographic light-sensitive material to be processed, it is generally 3 liters or less per $m^2$ of the light-sensitive material. The quantity of a replenisher can be decreased to be 500 ml or less by decreasing a bromide ion concentration in the replenisher when the quantity of a replenisher is to be decreased, a contact area of a processing tank with air is preferably decreased to prevent evaporation and oxidation of the replenisher.

A contact area of a photographic processing solution with air in a processing tank can be represented by an aperture defined below:

$$\text{Aperture} = \frac{\text{contact area (cm}^2\text{) of processing solution with air}}{\text{volume (cm}^3\text{) of processing solution}}$$

The above aperture is preferably 0.1 or less, and more preferably, 0.001 to 0.05. In order to reduce the aperture, a shielding member such as a floating cover may be provided on the liquid surface of the photographic processing solution in the processing tank. In addition, a method of using a movable cover described in JP-A-1-82033 or a slit developing method described in JP-A-63-216050 may be used. The aperture is preferably reduced not only in color and black-and-white development steps but also in all subsequent steps, e.g., bleaching, bleach-fixing, fixing, washing, and stabilizing steps. In addition, a quantity of replenisher can be reduced by using a means of suppressing accumulation of bromide ions in the developing solution.

A reversal bath used for the B/W development can contain a known fogging agent. Examples of the fogging agent are stannous ion complex salts, such as stannous ion-organic phosphoric acid complex salt (U.S. Pat. No. 3,617,282), stannous ion organic phosphonocarboxylic acid complex salt (JP-B-56-32616), and stannous ionaminopolycarboxylic acid complex salt (U.S. Pat. No. 1,209,050), and boron compounds, such as a boron hydride compound (U.S. Pat. No. 2,984,567) and a heterocyclic amineborane compound (British Patent 1,011,000). The pH of this fogging bath (reversal bath) covers a wide range from acidic to alkaline sides. The pH is 2 to 12, preferably 2.5 to 10, and most preferably 3 to 9. Photoreversal using re-exposure may be performed instead of the reversal bath. Alternatively, the reversal step itself may be omitted by adding the above fogging agent to the color developing solution.

The silver halide color photographic light-sensitive material of the present invention is subjected to bleaching or bleach-fixing after the color development. These processes may be performed immediately after the color development without performing any other processing. Alternatively, in order to prevent unnecessary post-development or aerial fog and reduce a carry-over of the color developing solution to a desilvering step or to wash out or make harmless the color developing agent impregnated in light-sensitive portions, such as sensitizing dyes or dyes contained in the photographic light-sensitive material, and impregnated in the photographic light-sensitive material, the light-sensitive material may be subjected to, e.g., stopping, conditioning, and washing, after the color development before it is subjected to the bleaching or the bleach-fixing.

The photographic emulsion layer is generally subjected to bleaching after color development. The bleaching may be performed either simultaneously with fixing (bleach-fixing) or independently of it. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, according to the intended use. Examples of the bleaching agent are a compound of a multivalent metal such as iron(III); peracids; quinones; and nitro compounds. Typical examples of the bleaching agent are organic complex salts of iron(III), e.g., complex salts of an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid; and complex salts of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent environmental contaminations. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfido group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-104232, JP-A-53-124424, and JP-A-53-141623, and JP-A-53-28426, and Research Disclosure No. 17,129 (July, 1978); a thiazolidine derivative described in JP-A-50-140129; iodide salts described in JP-B-45-8506, JP-A-52-20832, JP-A-53-32735, U.S. Pat. No. 3,706,561, and JP-A-58-16235; polyoxyethylene compounds described in West German Patents 977,410 and 2,748,430; a polyamine compound described in JP-B-45-8836; compounds described in JP-A-49-40943, JP-A-49-59644, JP-A-53-94927, JP-A-54-35727, JP-A-55-26506, and JP-A-58-163940; and bromide ions. Of these compounds, a compound having a mercapto group or a disulfido group is preferable since the compound has a large accelerating effect. In particular, compounds described in U.S. Pat. No. 3,893,858, west German Patent 1,290,812, and JP-A-53-95630 are preferred. A compound described in U.S. Pat. No. 4,552,834 is also preferable. These bleaching accelerators may be added in the light-sensitive material. These bleaching accelerators are effective especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, for example, acetic acid, propionic acid, or hydroxyacetic acid.

Examples of the fixing agent for use in the fixing or bleach-fixing solution are a thiosulfate, a thiocyanate, a thioether-based compound, a thiourea and a large amount of an iodide. Of these compounds, a thiosulfate, especially, ammonium thiosulfate can be used in the widest range of applications. In addition, a combination of a thiosulfate and a thiocyanate, a thioether-based compound or a thiourea is preferably used. As a preservative of the fixing or bleach-fixing solution, a sulfite, a bisulfite, a carbonyl bisulfite adduct, or a sulfinic acid compound described in EP 294, 769A is preferred. In addition, in order to stabilize the fixing solution or the bleach-fixing solution, various types of aminopolycarboxylic acids or organic phosphonic acids are preferably added to the solution. The total time of a desilvering step is preferably as short as possible provided that no desilvering inadequacy occurs. A preferable time is one to three minutes, and more preferably, one to two minutes. The processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of strengthening the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyor means described in JP-A-60-191257, JP-A-191258, or JP-A-60-191259. As described in JP-A-60-191257, this conveyor means can significantly reduce a carry-over of a processing solution from a pre-bath to a post-bath, thereby effectively preventing degradation in performance of the processing solution. This effect significantly shortens especially a processing time in each processing step and reduces the quantity of a replenisher for each processing solution.

The photographic light-sensitive material of the present invention is normally subjected to washing and/or stabilizing steps after desilvering. An amount of water used in the washing step can be selected within a broad range in accordance with the properties (e.g., a property determined by used substances such as a coupler) of the light-sensitive material, the intended use of the material, the temperature of the water, the number of water tanks (the number of stages), a replenishing scheme such as a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). According to the above-described multi stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing the photographic light-sensitive material of the present invention is 4 to 9, and preferably, 5 to 8. The water temperature and the washing time can vary in accordance with the properties and the intended use of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilization is sometimes performed subsequently to washing. An example is a stabilizing bath containing a dye stabilizing agent and a surface-active agent to be used as a final bath of the photographic color light-sensitive material. Examples of the dye stabilizing agent are an aldehyde such as formalin and glutaraldehyde, an N-methylol compound, hexamethylenetetramine, and an aldehyde sulfurous acid adduct. various chelating agents or antifungal agents can also be added to this stabilizing bath.

An overflow solution produced upon washing and/or replenishment of the stabilizing solution can be resued in another step such as a desilvering step.

In the processing using an automatic developing machine or the like, if each processing solution described above is concentrated by evaporation, water is preferably added to correct the concentration.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

Examples of the present invention will now be described in detail, but the invention is not limited to these Examples.

EXAMPLE 1

Preparation of Emulsions (1) Preparation of Emulsion A 0.19 g of PLURONIC TM-31R1 of BASF Co., indicated below, was added to 1.0 liter of an aqueous solution containing 0.7 g of potassium bromide, 0.4 g of oxidized gelatin and 4 cc of 4N nitric acid, and while stirring the solution at 45° C., 2.8 cc of an aqueous solution containing 0.37 g of silver nitrate and 2.8 cc of an aqueous solution containing 0.27 g of potassium bromide were added thereto by the double jet method over 60 seconds with a pAg maintained at 9.7. Then, an aqueous solution containing 2.3 g of potassium bromide was added thereto, and the temperature of the solution was increased up to 60° C. over 9 minutes. Thereafter, an aqueous ammonia solution containing 3.4 g of ammonium sulfate and 27.0 cc of 2.5N NaOH aqueous solution was added, and the solution was stirred for further 9 minutes. After that, 95 cc of an aqueous solution containing 17 g of oxidized alkali-processed gelatin and 10.8 cc of 4N nitric acid were further added over 2 minutes. Then, 7.5 cc of an aqueous solution containing 1.02 g of silver nitrate and 8.3 cc of an aqueous solution containing 0.79 g of potassium bromide were added over 5 minutes. Further, 475 cc of an aqueous solution containing 129 g of silver nitrate and 475 cc of an aqueous solution containing 95 g of potassium bromide were added over 60 minutes at an accelerated flow rate (the flow rate at the time of finish is 10 times as high as that of the beginning). During this addition, pBr was maintained at 2.4. Next, 200 cc of an aqueous solution containing 3.9 g of potassium iodide was added over 2 minutes. 2 minutes later, 250 cc of an aqueous solution containing 68.8 g of silver nitrate and 250 cc of an aqueous solution containing 50.3 g potassium bromide were added over 19 minutes at a constant flow rate. After that, the prepared emulsion was desalted by the conventional flocculation method. After adjusting the emulsion to pH of 6.5 and pAg of 8.5 at 40° C., the emulsion was subjected to optimal chemical sensitization by sodium thiosulfate, chloroauric acid and potassium thiocyanate in the presence of sensitizing dyes S-6 and S-7, indicated below, thereby obtaining a tabular silver bromoiodide emulsion A (AgI content: 2.0 mol %).

The average equivalent-circle diameter of the grains obtained was 2.0 μm, the average thickness of the grains was 0.18 μm, the average aspect ratio was 11, the ratio of the projected area of the tabular grains having an aspect ratio of 2 or more to that of all the grains was 99%, and the variation coefficient of the grain size distribution was 5%.

The emulsion A exhibited 2 signal peaks at 73.12 degrees and 73.3 degrees (peaks 1 and 2 in FIG. 1) in the (420) X-ray diffraction obtained using $K_\alpha$ line of Cu, and the peak interval thereof was 0.18 degrees in terms of diffraction angle. Further, the diffraction line width at the height of the maximum peak×0.13 was 0.625 degrees.

PLURONIC used:

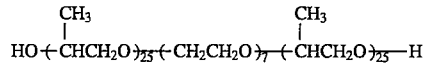

(2) Preparation of Emulsion B

Emulsions B-1 to B-5 were prepared in the same manner as of Emulsion A except that the PLURONIC TM-31R1 used in the emulsion A was changed to the compound listed in Table 3 below.

TABLE 3

| Emulsion | Compound added to emulsion | Amount of addition (g) |
|---|---|---|
| B-1 | P-1 | 0.09 |
| B-2 | P-1 | 0.19 |
| B-3 | P-6 | 0.19 |
| B-4 | P-7 | 0.19 |
| B-5 | P-19 | 0.19 |

As in the case of the emulsion A, each of the emulsions B-1 to B-5 exhibited 2 signal peaks in the (420) X-ray diffraction obtained using $K_\alpha$ line of Cu.

Further, as to each of the emulsions, the ratio of the projected area of the tabular grains having an aspect ratio of 2 or more to that of all the grains was 98% or more.

(3) Preparation of Emulsion C 0.19 g of PLURONIC TM-31R1 of BASF Co. was added to 1.0 liter of an aqueous solution containing 0.7 g of potassium bromide, 0.4 g of oxidized gelatin and 4 cc of 4N nitric acid, and while stirring the solution at 45° C., 2.8 cc of a solution containing 0.37 g of silver nitrate and 2.8 cc of an aqueous solution containing 0.27 g of potassium bromide were added thereto by the double jet method over a time period of 60 seconds with a pAg maintained at 9.7. Then, an aqueous solution containing 2.3 g of potassium bromide was added thereto, and the temperature of the solution was increased up to 60° C. over 9 minutes. Next, an aqueous ammonia solution containing 3.4 g of ammonium sulfate and 27.0 cc of a 2.5N NaOH aqueous solution was added thereto, and the solution was stirred for 9 minutes. After that, 95 cc of an aqueous solution containing 17 g of oxidized alkali-processed gelatin and 10.8 cc of 4N nitric acid were further added over 2 minutes. Then, 7.5 cc of an aqueous solution containing 1.02 g of silver nitrate and 8.3 cc of an aqueous solution containing 0.78 g of potassium bromide and 0.02 g of potassium iodide were added over 5 minutes. Further, 475 cc of an aqueous solution containing 129 g of silver nitrate and 475 cc of an aqueous solution containing 93 g of potassium bromide and 2.53 g of potassium iodide were added over 60 minutes at an accelerated flow rate (the flow rate at the time of finish is 10 times as high as that of the beginning). During this addition, pBr was maintained at 2.4. After that, 250 cc of an aqueous solution containing 68.8 g of silver nitrate and 250 cc of an aqueous solution containing 49.3 g of potassium bromide and 1.35 g of potassium iodide were added over 19 minutes at a constant flow rate. After that, the prepared emulsion was desalted by the conventional flocculation method. After adjusting the emulsion to pH of 6.5 and pAg of 8.5 at 40° C., the emulsion was subjected to optimal chemical sensitization by sodium thiosulfate, chloroauric acid and potassium thiocyanate in the presence of sensitizing dyes S-6 and S-7, thereby obtaining a tabular silver bromoiodide emulsion C (AgI content: 2.0 mol %).

The average equivalent-circle diameter of the grains obtained was 1.6 μm, the average thickness of the grains was 0.22 μm, the average aspect ratio was 7, the ratio of the projected area of the tabular grains having an aspect ratio of 2 or more to that of all the grains was 98%, and the variation coefficient of the grain size distribution was 8%.

The emulsion C, as the emulsion A, exhibited 2 signal peaks in the (420) X-ray diffraction obtained using $K_\alpha$ line of Cu, and the peak interval thereof was 0.15 degrees in terms of diffraction angle. Further, the diffraction line width at the height of the maximum peak×0.13 was 0.638 degrees.

(4) Preparation of Emulsion D 0.19 g of PLURONIC TM-31R1 of BASF Co. was added to 1.0 liter of an aqueous solution containing 0.7 g of potassium bromide, 0.4 g of oxidized gelatin and 4 cc of 4N nitric acid, and while stirring the solution at 45° C., 2.8 cc of an aqueous solution containing 0.37 g of silver nitrate and 2.8 cc of an aqueous solution containing 0.27 g of potassium bromide were added thereto by the double Jet method over 60 seconds with a pAg maintained at 9.7. Then, an aqueous solution containing 2.3 g of potassium bromide was added thereto, and the temperature of the solution was increased up to 60° C. over 9 minutes. Next, an aqueous ammonia solution containing 3.4 g of ammonium sulfate and 27.0 cc of a 2.5N NaOH aqueous solution was added thereto, and the solution was stirred for 9 minutes. After that, 95 cc of an aqueous solution containing 17 g of oxidized alkali-processed gelatin and 10.8 cc of 4N nitric acid were further added over 2 minutes. Then, 7.5 cc of an aqueous solution containing 1.02 g of silver nitrate and 8.3 cc of an aqueous solution containing 0.79 g of potassium bromide and 0.01 g of potassium iodide were added over 5 minutes. Further, 475 cc of an aqueous solution containing 129 g of silver nitride and 475 cc of an aqueous solution containing 93 g of potassium bromide and 2.99 g of potassium iodide were added over 60 minutes at an accelerated flow rate (the flow rate at the time of finish is 10 times as high as that of the beginning). During this addition, pBr was maintained at 2.4. Next, 100 cc of an aqueous solution containing 0.6 g of potassium iodide was added over 2 minutes. Two minutes later, 250 cc of an aqueous solution containing 68.8 g of silver nitrate and 250 cc of an aqueous a solution containing 50.1 g potassium bromide and 0.3 g of potassium iodide were added over 19 minutes at a constant flow rate. After that, the prepared emulsion was desalted by the conventional flocculation method. After adjusting the emulsion to pH of 6.5 and pAg of 8.5 at 40° C., the emulsion was subjected to optimal chemical sensitization by sodium thiosulfate, chloroauric acid and potassium thiocyanate in the presence of sensitizing dyes S-6 and S-7, thereby obtaining a tabular silver bromoiodide emulsion D (AgI content: 2.0 mol %).

The average equivalent-circle diameter of the grains obtained was 1.2 μm, the average thickness of the grains was 0.27 μm, the average aspect ratio was 4.5, the ratio of the projected area of the tabular grains having an aspect ratio of 2 or more to that of all the grains was 98%, and the variation coefficient of the grain size distribution was 11%.

The emulsion D exhibited a signal peak having a diffraction line width of 0.825 degree at 73.15 degree in the (420) X-ray diffraction obtained using $K_\alpha$ line of Cu.

(5) Preparation of Emulsion E

An emulsion E was prepared in the same manner as of Em-1 of JP-A-3-168734.

Specifically, while stirring 0.72 liter of an aqueous solution containing 5.3 g of potassium bromide, 2.4 g of potassium iodide and 15 g of gelatin at 40° C., 600 cc of an aqueous solution containing 150 g of silver nitrate and 300 cc of an aqueous solution containing 132.7 g of potassium bromide and 0.03 g of 1-phenyl-5-mercaptotetrazole were added thereto over 30 seconds with pBr kept at 1.12. After 1 minute and 30 seconds later, an aqueous potassium bromide solution and an ammonia water were added to the mixture to carry out ripening for 5 minutes. During the ripening, the KBr concentration was 0.071 mol/liter and the ammonia concentration was 0.63 mol/liter. Next, the pH was adjusted to 6.0, and the emulsion was desalted by the conventional flocculation method.

Thus, a monodisperse spherical emulsion having an average grain size of 0.37 μm and a variation coefficient of the grain size distribution of 18% was obtained.

While stirring 0.4 liter of an aqueous solution containing 0.098 mol equivalence of the obtained monodisperse spherical emulsion as seed emulsion, and 8.5 g of ossein gelatin and disodium propyleneoxy-polyethyleneoxy-disuccinate (1 cc of 10% methanol solution thereof) at 75° C., 108 cc of an aqueous solution containing 35 g of silver nitrate and 180 cc of an aqueous solution containing 3.61 g of potassium bromide, 1.92 g of potassium iodide and 4.33 g of ossein gelatin were added thereto over 16 minutes at an accelerated flow rate (the flow rate at the time of finish is 1.27 times as high as that of the beginning). During this addition, pH and pAg were maintained at 2.0 and 8.0, respectively. Next, 221 cc of an aqueous solution containing 97.7 g of silver nitrate and an aqueous solution containing 2.54 g of potassium iodide, 68.2 g of potassium bromide and 4.4 g of gelatin were added thereto over 16 minutes at an accelerated flow rate (the flow rate at the time of finish is 1.8 times as high as that of the beginning). During this addition, pH and pAg were maintained at 2.0 and 8.0, respectively. After that, the prepared emulsion was desalted by the conventional flocculation method. After adjusting the emulsion to pH of 6.5 and pAg of 8.5 at 40° C., the emulsion was subjected to optimal chemical sensitization by sodium thiosulfate, chloroauric acid and potassium thiocyanate in the presence of sensitizing dyes S-6 and S-7 at 65° C., thereby obtaining a tabular silver bromoiodide emulsion E (AgI content: 2.0 mol %).

The average equivalent-circle diameter of the grains obtained was 0.9 μm, the average thickness of the grains was 0.6 μm, the average aspect ratio was 1.5, and the variation coefficient of the grain size distribution was 13%.

The emulsion E exhibited a signal peak having a diffraction line width of 0.838 degree at 73.15 degree (peak 1 in FIG. 2) in the (420) X-ray diffraction obtained using $K_\alpha$ line of Cu.

(6) Preparation of Emulsion F Emulsion F was prepared in the same manner as of the emulsion A except that the amount of potassium iodide added in the case of the emulsion A was changed to 13.6 g.

The average equivalent-circle diameter of the grains obtained was 1.1 μm, the average thickness of the grains was 0.31 μm, the average aspect ratio was 3.5, the ratio of the projected area of the tabular grains having an aspect ratio of 2 or more to that of all the grains was 85%, and the variation coefficient of the grain size distribution was 25%.

The emulsion F exhibited two signal peaks in the (420) X-ray diffraction obtained using $K_\alpha$ line of Cu. The peak interval was 1.33 degrees in terms of diffraction angle, and the diffraction line width at the maximum peak height×0.13 was 1.53.

The emulsions thus obtained are shown in Table 4 below.

TABLE 4

| Emulsion | Average equivalent-circule diameter (μm) | Average thickness (μm) | Average aspect ratio | Variation coefficient of grain size distribution (%) | X-ray diffraction: Number of peak(s) | X-ray diffraction: Peak interval (degree) | X-ray diffraction: Diffraction line width at peak height × 0.13 (degree) |
|---|---|---|---|---|---|---|---|
| A (present invention) | 2.0 | 0.18 | 11 | 5 | 2 | 0.18 | 0.625 |
| B-1 (present invention) | 2.1 | 0.14 | 15 | 8 | 2 | 0.18 | 0.631 |
| B-2 (present invention) | 1.5 | 0.23 | 6.5 | 5 | 2 | 0.17 | 0.620 |
| B-3 (present invention) | 1.7 | 0.19 | 9 | 7 | 2 | 0.18 | 0.635 |
| B-4 (present invention) | 1.6 | 0.20 | 8 | 6 | 2 | 0.17 | 0.650 |
| B-5 (present invention) | 1.3 | 0.26 | 5 | 15 | 2 | 0.18 | 0.622 |
| C (Comparative example) | 1.6 | 0.22 | 7 | 8 | 2 | 0.15 | 0.638 |
| D (comparative example) | 1.2 | 0.27 | 4.5 | 11 | 1 | — | 0.825 |
| E (Comparative example) | 0.9 | 0.6 | 1.5 | 13 | 1 | — | 0.838 |
| F (Comparative example) | 1.1 | 0.31 | 3.5 | 25 | 2 | 1.33 | 1.53 |

Figure 2:
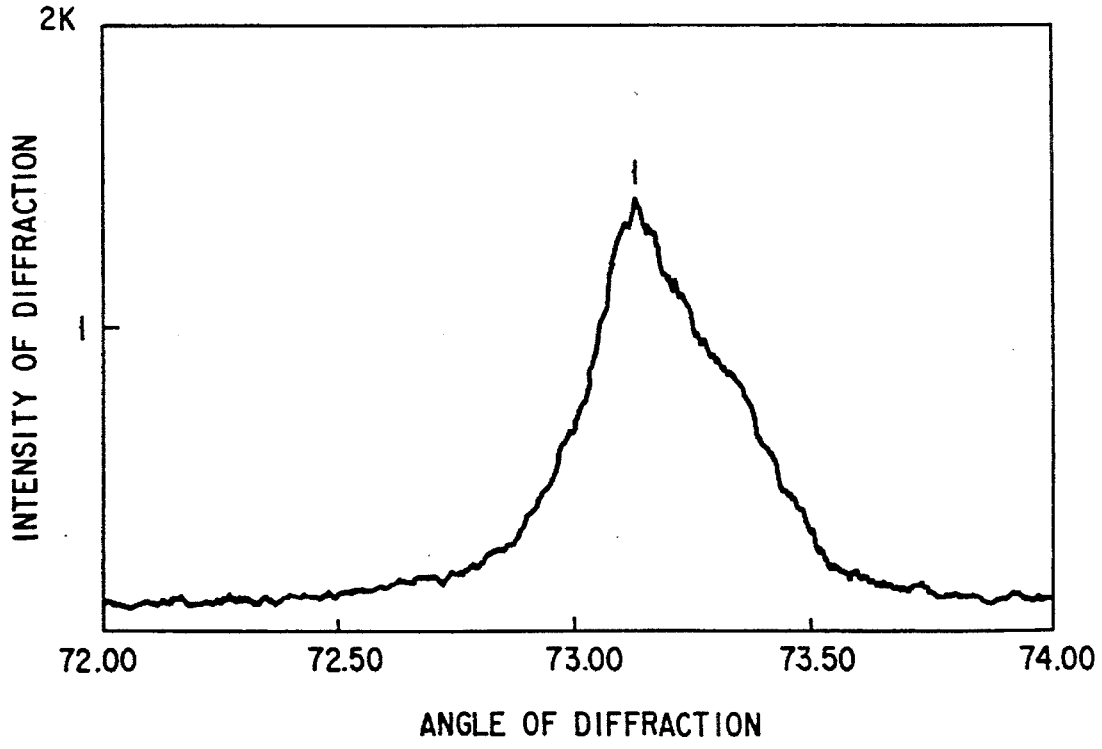
FIG. 2 is a graph showing an X-ray diffraction signal of emulsion E described below.

The X-ray diffraction signals of the emulsions A and E are illustrated in FIGS. 1 and 2, respectively.

Preparation of Coated Samples and Evaluation thereof

To each of the emulsion obtained, dodecylbenzenesulfonate as a coating aid, p-vinylbenzenesulfonate as a thickener, vinylsulfone compound as a film hardener, and a polyethyleneoxide compound as a photographic property improver were added to prepare emulsion coating solutions. These coating solutions were applied uniformly on separate polyester bases each provided with an underlayer, and a surface protective layer consisting mainly of an aqueous gelatin solution was applied on each of the emulsion layer, thereby obtaining coated samples 101 to 110 having emulsions A, B-1 to B-5, and C to F, respectively. The amount of silver applied on each of the samples 101 to 110 was 50 $g/m^2$, the amount of gelatin applied on each of the protective layers was 1.3 $g/m^2$, and the amount of gelatin applied on each of the emulsion layers was 2.7 $g/m^2$.

In order to evaluate the coated samples thus obtained, the following test was carried out.

A sample piece from each of the coated samples 101 to 110 was wedge-exposed for an exposure time of 1/100 second and at an exposure amount of 10 CMS. Each sample piece was developed by a processing solution having the composition listed below for 4 minutes. Then, each sample piece was fixed, water-washed and dried, and then subjected to sensitometry. Thus, the photographic sensitivity of each sample was obtained from a reciprocal of the exposure amount (lux.sec) required to impart an optical density of fog+0.1, and the gamma value was obtained from a slope of a straight line connecting a point where D=0.2 and a point where D=0.8 on a characteristic curve.

Further, two sets of the sample pieces from each of the coating samples 101 to 110 were prepared. After wedge-exposing all of them for 1/100", one set is preserved for 3 days at 50° C. and at RH of 55%, and the other set is preserved in a freezer to provide a control. After that, these samples were developed as in the manner described above, and were evaluated in terms of latent image storability.

The evaluation in terms of resistance to pressure was conducted in the following manner. The coated film samples were bent at a degree of 180° by use of an iron rod having a diameter of 1 mm under the conditions in which the relative humidity was adjusted to 40% at 25° C. Immediately after that, the coated samples were exposed for sensitometry for $10^{-2}$ second. The exposed samples were developed in the same manner as described above. The value of the ratio ΔFog/Dmax, i.e., the difference ΔFog defined between the fog density of the bent portion of an obtained sample and that of the unbent portion, to the maximum density Dmax, was expressed in percentage.

| Processing solution | |
|---|---|
| 1-phenyl-3-pyrazolidone | 0.5 g |
| Hydroquinone | 10 g |
| Disodium ethylenediaminetetraacetate | 2 g |
| Potassium sulfite | 60 g |
| Boric acid | 4 g |
| Potassium carbonate | 20 g |
| Sodium bromide | 5 g |
| Diethyleneglycol | 20 g |
| Sodium hydroxide to adjust pH to | 1 |
| Water to make | 1 liter |

TABLE 5

| Sample No. | Emulsion coated | Relative Sensitivity | Gradation (gamma) | Latent image storability (change in sensitivity after stored at 50° C., 55% for 3 days) | Pressure-resistant property (ΔFog/Dmax) |
|---|---|---|---|---|---|
| 101 (Present invention) | A | 100 | 1.10 | 0.03 | 1% |
| 102 (Present invention) | B-1 | 105 | 1.13 | 0.04 | 3% |
| 103 (Present invention) | B-2 | 102 | 1.21 | 0.02 | 1% |
| 104 (Present invention) | B-3 | 98 | 1.15 | 0.03 | 2% |
| 105 (Present invention) | B-4 | 95 | 1.12 | 0.02 | 2% |
| 106 (Present invention) | B-5 | 90 | 1.07 | 0.04 | 4% |
| 107 (Present invention) | C | 92 | 1.08 | 0.04 | 4% |
| 108 (Comparative example) | D | 75 | 0.98 | 0.10 | 10% |
| 109 (Comparative example) | E | 51 | 0.08 | 0.12 | 18% |
| 110 (Comparative exmpal) | F | 63 | 0.59 | 0.27 | 25% |

As can be seen from Table 5, each of the samples coated with the emulsions of the present invention exhibited a high sensitivity, a high gradation, less fog when a pressure is applied before exposure, and a good latent image storability.

EXAMPLE 2

A multilayer having the below-specified compositions was formed on a subbed triacetylcellurose film substrate having a thickness of 127 μm, thereby obtaining a sample 201.

Each numeral indicates an amount of addition per $m^2$. Note that the effects of each of the compounds are not limited to the usage described.

| | | |
|---|---|---|
| Layer 1: Antihalation layer | | |
| Black colloidal silver | | 0.20 g |
| Gelatin | | 1.9 g |
| UV absorbent U-1 | | 0.1 g |
| UV absorbent U-3 | | 0.04 g |
| UV absorbent U-4 | | 0.1 g |
| High boiling point organic solvent Oil-1 | | 0.1 g |
| Microcrystalline solid dispersion of Dye E-1 | | 0.1 g |
| Layer 2: Interlayer | | |
| Gelatin | | 0.40 g |
| Compound Cpd-C | | 5 mg |
| Compound Cpd-J | | 5 mg |
| Compound Cpd-K | | 3 mg |
| High boiling point organic solvent Oil-3 | | 0.1 g |
| Dye D-4 | | 0.8 mg |
| Layer 3: Interlayer | | |
| Surface-fogged and internally fogged fine grain silver bromoiodide emulsion (average grain diameter: 0.06 μm, variation coefficient: 18%, and AgI content: 1 mol %) | Amount of silver | 0.05 g |
| Yellow colloidal silver | Amount of silver | 0.05 g |
| Gelatin | | 0.4 g |
| Layer 4: Low-speed red-sensitive emulsion layer | | |
| Emulsion AA | Amount of silver | 0.1 g |
| Emulsion BB | Amount of silver | 0.4 g |
| Internally fogged fine grain silver bromoiodide emulsion (average grain diameter: 0.06 μm, variation coefficient: 18%, and AgI content: 1 mol %) | Amount of silver | 0.05 g |

-continued

| | | |
|---|---|---|
| Gelatin | | 0.8 g |
| Coupler C-1 | | 0.15 g |
| Coupler C-2 | | 0.05 g |
| Coupler C-3 | | 0.05 g |
| Coupler C-9 | | 0.05 g |
| Compound Cpd-C | | 5 mg |
| Compound Cpd-J | | 5 mg |
| High boiling point organic solvent Oil-2 | | 0.1 g |
| Additive PL-1 | | 0.1 g |
| Layer 5: Medium-speed red-sensitive emulsion layer | | |
| Emulsion CC | Amount of silver | 0.5 g |
| Internally fogged fine grain silver bromoiodide emulsion (average grain diameter: 0.06 μm, variation coefficient: 18%, and AgI content: 1 mol %) | Amount of silver | 0.05 g |
| Gelatin | | 0.8 g |
| Coupler C-1 | | 0.2 g |
| Coupler C-2 | | 0.05 g |
| Coupler C-3 | | 0.2 g |
| High boiling point organic solvent Oil-2 | | 0.1 g |
| Additive PL-1 | | 0.1 g |
| Layer 6: High-speed red-sensitive emulsion layer | | |
| Emulsion DD | Amount of silver | 0.4 g |
| Gelatin | | 1.1 g |
| Coupler C-1 | | 0.3 g |
| Coupler C-2 | | 0.1 g |
| Coupler C-3 | | 0.7 g |
| Additive PL-1 | | 0.1 g |
| Layer 7: Interlayer | | |
| Gelatin | | 0.6 g |
| Additive M-1 | | 0.2 g |
| Color mixting inhibitor Cpd-1 | | 2.6 mg |
| Dye D-5 | | 0.02 g |
| Compound Cpd-J | | 5 mg |
| High boiling point organic solvent Oil-1 | | 0.02 g |
| Layer 8: Interlayer | | |
| Surface-fogged and internally fogged silver bromoiodide emulsion (average grain diameter: 0.06 μm, variation coefficient: 16%, and AgI content: 0.3 mol %) | Amount of silver | 0.02 g |
| Yellow colloidal silver | silver | 0.02 g |
| Gelatin | | 1.0 g |
| Additive PL-1 | | 0.2 g |
| Color mixing inhibitor Cpd-A | | 0.1 g |
| Compound Cpd-C | | 0.1 g |
| Layer 9: Low-speed green-sensitive emulsion layer | | |
| Emulsion EE | Amount of silver | 0.3 g |
| Emulsion FF | Amount of silver | 0.2 g |
| Internally fogged fine grain silver bromoiodide emulsion (average grain diameter: 0.06 μm variation coefficient: 18%, and AgI content: 1 mol %) | Amount of silver | 0.04 g |
| Gelatin | | 0.5 g |
| Coupler C-4 | | 0.1 g |
| Coupler C-7 | | 0.05 g |
| Coupler C-8 | | 0.20 g |
| Compound Cpd-B | | 0.03 g |
| Compound Cpd-D | | 0.02 g |
| Compound Cpd-E | | 0.02 g |
| Compound Cpd-F | | 0.04 g |
| Compound Cpd-J | | 10 mg |
| Compound Cpd-L | | 0.02 g |
| High boiling point organic solvent Oil-1 | | 0.1 g |
| High boiling point organic solvent Oil-2 | | 0.1 g |
| Layer 10: Medium-speed green-sensitive emulsion layer | | |
| Emulsion FF | Amount of silver | 0.3 g |
| Emulsion GG | Amount of silver | 0.1 g |
| Internally fogged fine grain silver bromoiodide emulsion (average grain diameter: 0.06 μm, variation coefficient: 18%, and AgI content: 1 mol %) | Amount of silver | 0.04 g |
| Gelatin | | 0.6 g |
| Coupler C-4 | | 0.1 g |
| Coupler C-7 | | 0.2 g |
| Coupler C-8 | | 0.1 g |
| Compound Cpd-B | | 0.03 g |
| Compound Cpd-D | | 0.02 g |

-continued

| | | |
|---|---|---|
| Compound Cpd-E | | 0.02 g |
| Compound Cpd-F | | 0.05 g |
| Compound Cpd-L | | 0.05 g |
| High boiling point organic solvent Oil-2 | | 0.01 g |
| Layer 11: High-speed green-sensitive emulsion layer | | |
| Emulsion HH | Amount of silver | 0.5 g |
| Gelatin | | 1.0 g |
| Coupler C-4 | | 0.3 g |
| Coupler C-7 | | 0.1 g |
| Coupler C-8 | | 0.1 g |
| Compound Cpd-B | | 0.08 g |
| Compound Cpd-E | | 0.02 g |
| Compound Cpd-F | | 0.04 g |
| Compound Cpd-K | | 5 mg |
| Compound Cpd-L | | 0.02 g |
| High boiling point organic solvent Oil-1 | | 0.02 g |
| High boiling point organic solvent Oil-2 | | 0.02 g |
| Layer 12: Interlayer | | |
| Gelatin | | 0.6 g |
| Compound Cpd-L | | 0.05 g |
| High boiling point organic solvent Oil-1 | | 0.05 g |
| Layer 13: Yellow filter layer | | |
| Yellow colloidal silver | Amount of silver | 0.07 g |
| Gelatin | | 0.01 g |
| Color mixing inhibitor Cpd-A | | 0.01 g |
| Compound Cpd-L | | 0.01 g |
| High boiling point organic solvent Oil-1 | | 0.01 g |
| Microcrystalline solid dispersion of Dye E-2 | | 0.05 g |
| Layer 14: Interlayer | | |
| Gelatin | | 0.6 g |
| Layer 15: Low-speed blue-sensitive emulsion layer | | |
| Emulsion II | Amount of silver | 0.4 g |
| Emulsion JJ | Amount of silver | 0.2 g |
| Gelatin | | 0.8 g |
| Coupler C-5 | | 0.2 g |
| Coupler C-6 | | 0.1 g |
| Coupler C-10 | | 0.4 g |
| Layer 16: Medium-speed blue-sensitive emulsion layer | | |
| Emulsion KK | Amount of silver | 0.4 g |
| Gelatin | | 0.9 g |
| Coupler C-5 | | 0.1 g |
| Coupler C-6 | | 0.1 g |
| Coupler C-10 | | 0.6 g |
| Layer 17: High-speed blue-sensitive emulsion layer | | |
| Emulsion A of Example 1 | Amount of silver | 0.4 g |
| Gelatin | | 1.2 g |
| Coupler C-5 | | 0.1 g |
| Coupler C-6 | | 0.1 g |
| Coupler C-10 | | 0.6 g |
| High boiling point organic solvent Oil-2 | | 0.1 g |
| Layer 18: First protective layer | | |
| Gelatin | | 0.7 g |
| UV absorbent U-1 | | 0.2 g |
| UV absorbent U-2 | | 0.05 g |
| UV absorbent U-5 | | 0.3 g |
| Formalin scavenger Cpd-H | | 0.4 g |
| Dye D-1 | | 0.15 g |
| Dye D-2 | | 0.05 g |
| Dye D-3 | | 0.1 g |
| Layer 19: Second protective layer | | |
| Colloidal silver | Amount of silver | 0.1 mg |
| Fine grain silver bromoiodide emulsion (average grain size: 0.06 μm, AgI content: 1 mol %) | silver | 0.1 g |
| Gelatin | | 0.4 g |
| Layer 20: Third protective layer | | |
| Gelatin | | 0.4 g |
| Polymethylmethacrylate (average grain size: 1.5 μm) | | 0.1 g |

-continued

| | |
|---|---|
| Silicone oil | 0.03 g |
| Surfactant W-1 | 3.0 mg |
| surfactant W-2 | 0.03 g |

In addition to the above compositions, all of the emulsion layers were added with additives F-1 to F-8. In addition, the individual layers were added with a gelatin hardener H-1 and surfactants W-3, W-4, W-5, and W-6 for coating and emulsification in addition to the above compositions.

Furthermore, the sample was also added with phenol, 1,2-benzisothiazolin-3-one, 2-phenoxyethanol, phenethyl alcohol, and butyl p-benzoate as antiseptic and mildew-proofing agents.

The silver iodobromide emulsions used in the sample 201 are listed in Table 6 below.

TABLE 6

| Emulsion name | Grain shape | | Average grain size (μm) | Variation coefficient (%) | AgI content (%) |
|---|---|---|---|---|---|
| AA | Monodisperse tetradecahedral grain | | 0.25 | 16 | 3.7 |
| BB | Monodisperse cubic grain | | 0.35 | 10 | 3.3 |
| CC | Monodisperse tabular grain | Average aspect ratio 4.0 | 0.47 | 18 | 5.0 |
| DD | Monodisperse tabular grain | Average aspect ratio 7.0 | 0.68 | 16 | 2.0 |
| EE | Monodisperse cubic grain | | 0.20 | 16 | 4.0 |
| FF | Monodisperse cubic grain | | 0.35 | 11 | 3.5 |
| GG | Monodisperse cubic grain | | 0.45 | 9 | 3.5 |
| HH | Monodisperse tabular grain | Average aspect ratio 7.0 | 0.80 | 13 | 1.5 |
| II | Monodisperse tetradecahedral grain | | 0.30 | 18 | 4.0 |
| JJ | Monodisperse cubic grain | | 0.40 | 14 | 3.5 |
| KK | Monodisperse tabular grain | Average aspect ratio 7.0 | 0.55 | 13 | 3.5 |
| A | Monodisperse tabular grain | Average aspect ratio 11 | 1.03 | 5 | 2.0 |

The sensitizing dyes were added as described in Table 7 below immediately before chemical sensitization of the emulsions AA to KK and A.

TABLE 7

| Emulsion | Sensitizing dyes added | Addition amount (m · mol) per mol of silver halide |
|---|---|---|
| AA | S-1 | 0.44 |
| | S-3 | 0.04 |
| BB | S-2 | 0.44 |
| | S-3 | 0.01 |
| CC | S-1 | 0.26 |
| | S-3 | 0.02 |
| | S-1 | 0.18 |
| DD | S-8 | 0.01 |
| | S-3 | 0.01 |
| EE | S-4 | 0.47 |
| | S-5 | 0.15 |
| FF | S-4 | 0.31 |
| | S-5 | 0.09 |
| GG | S-4 | 0.30 |
| | S-5 | 0.09 |
| | S-10 | 0.47 |
| HH | S-5 | 0.06 |
| | S-9 | 0.13 |
| II | S-7 | 0.27 |
| | S-6 | 0.07 |
| JJ | S-7 | 0.29 |
| | S-6 | 0.09 |

TABLE 7-continued

| Emulsion | Sensitizing dyes added | Addition amount (m · mol) per mol of silver halide |
|---|---|---|
| KK | S-7 | 0.50 |
| | S-6 | 0.15 |
| A | S-7 | 0.30 |
| | S-6 | 0.10 |

The compounds added in the manufacture of the sample 201 were as follows,

C-1
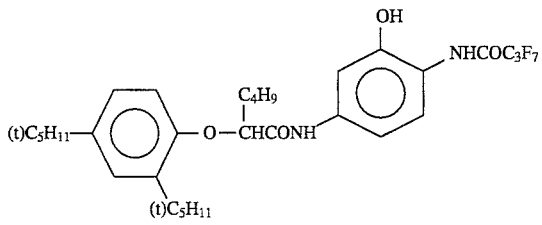
C-2
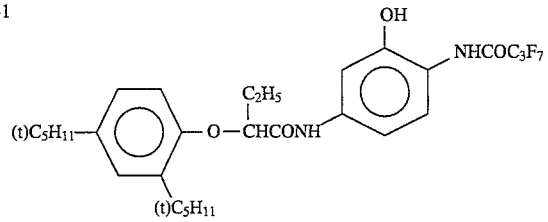
C-3
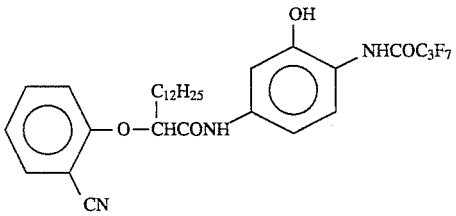
C-4
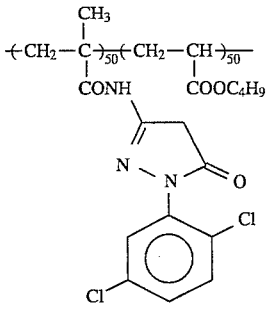
Numbers represent wt %
Average molecular weight
about 25,000
C-5
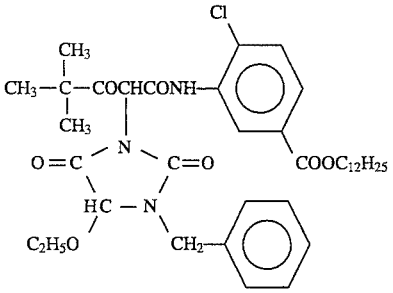
C-6
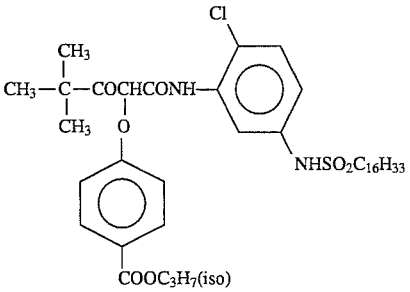
C-7
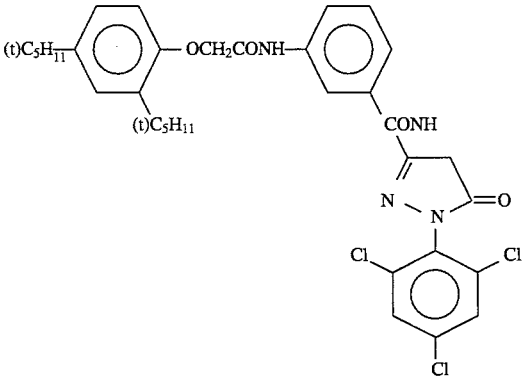
C-8
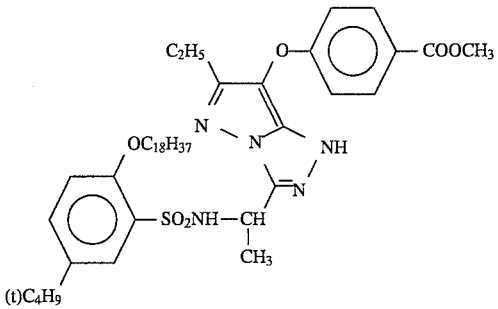
C-9
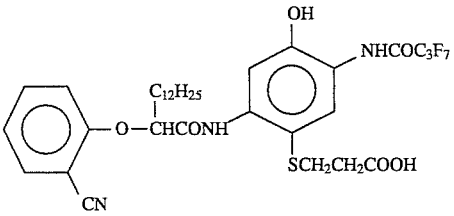
C-10
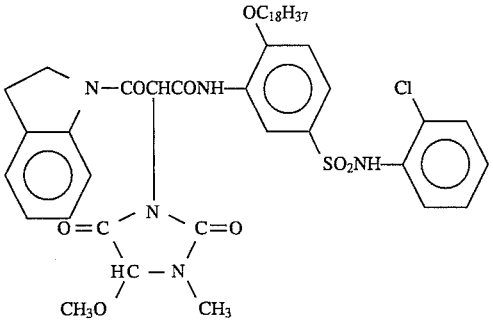

-continued
C-11
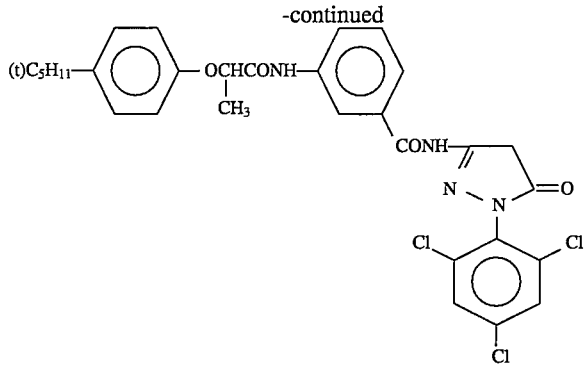
Dibutyl phthalate Oil-1
Tricresyl phosphate Oil-2
Oil-3
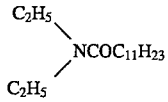
Cpd-A
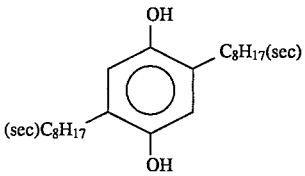
Cpd-B
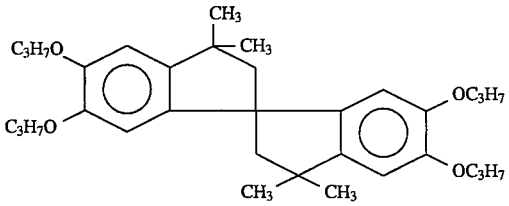
Cpd-C
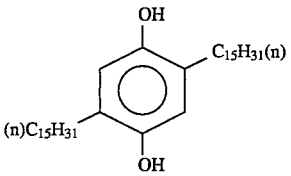
Cpd-D
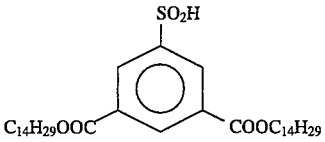
Cpd-E
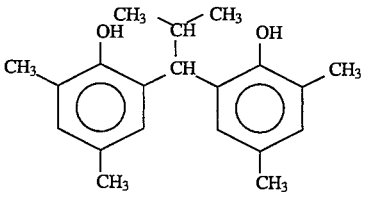
Cpd-F
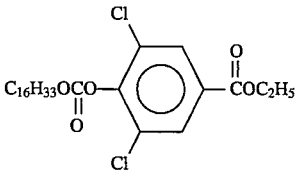
Cpd-H
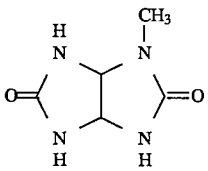
Cpd-I
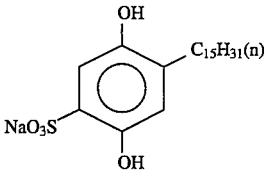
Cpd-J
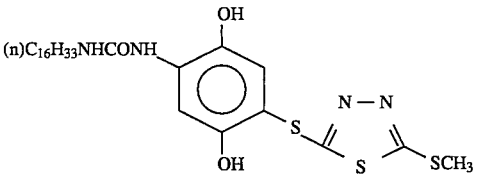
Cpd-K
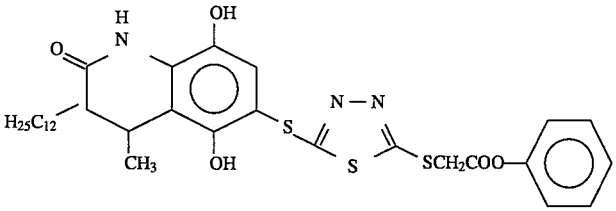

-continued
Cpd-L
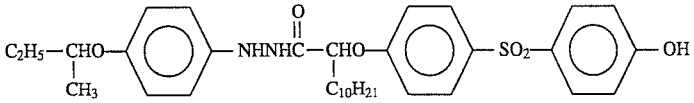
U-1
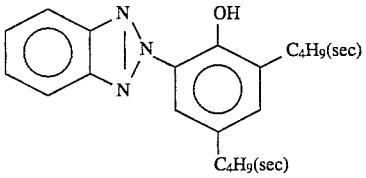
U-2
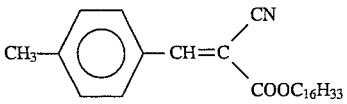
U-3
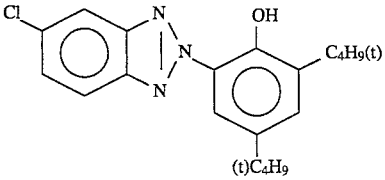
U-4
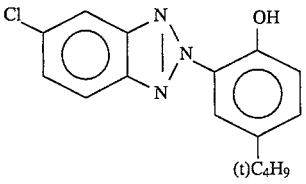
U-5
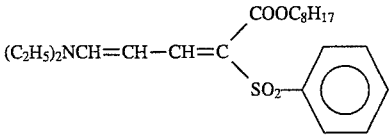
S-1
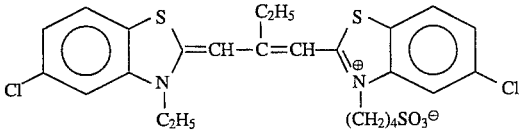
S-2
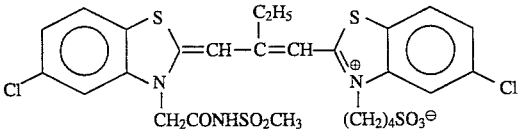
S-3
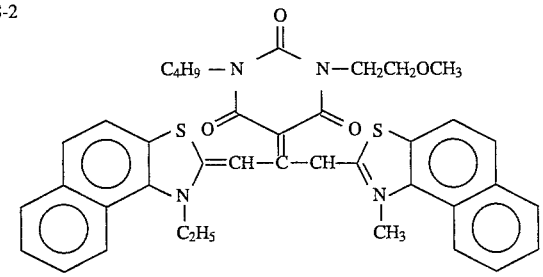
S-4
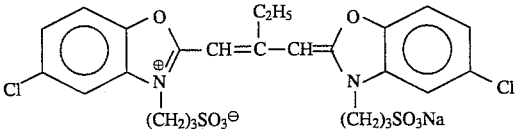
S-5
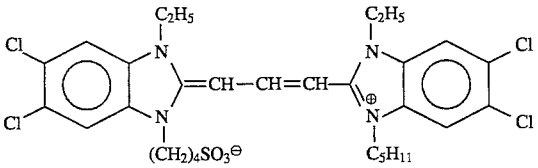
S-6
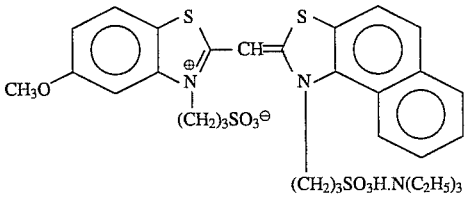
S-7
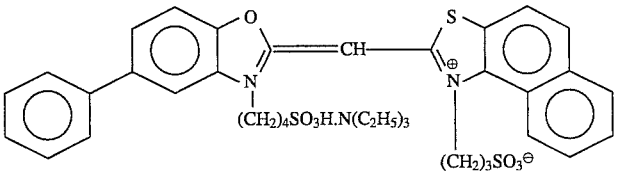
S-8
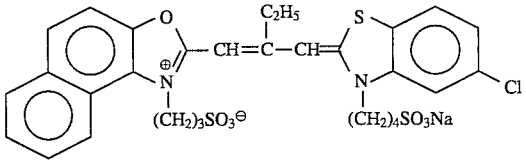

-continued
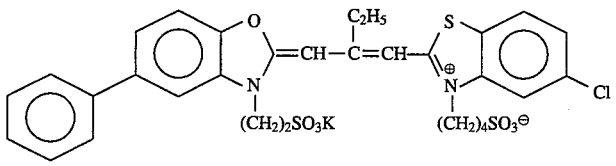
S-9
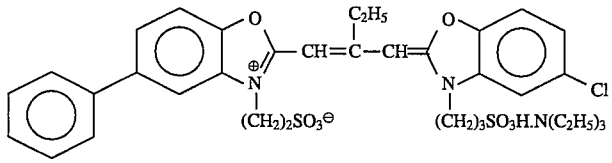
S-10
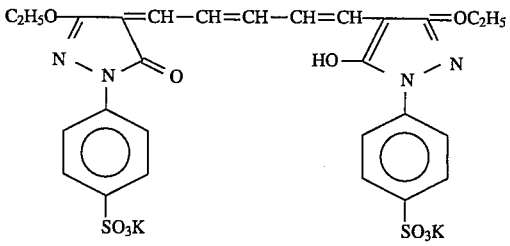
D-1
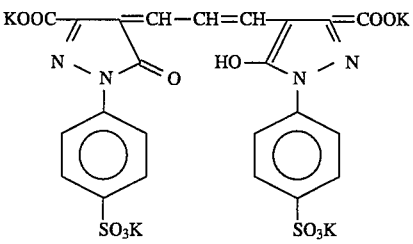
D-2
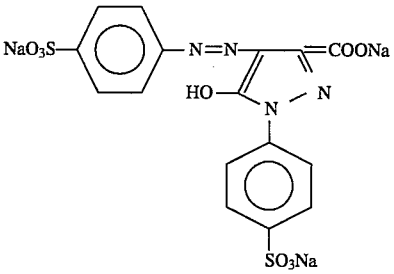
D-3
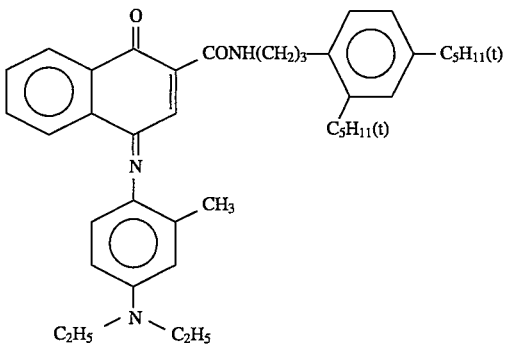
D-4
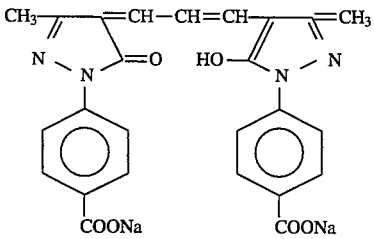
D-5
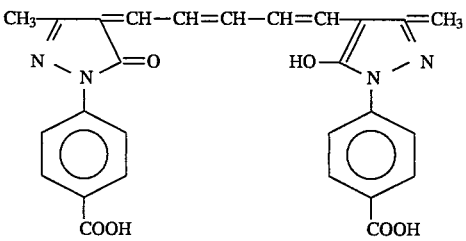
E-1
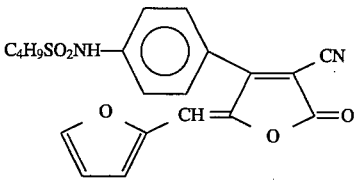
E-2
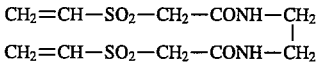
H-1
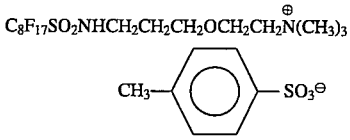
W-1
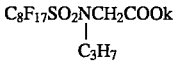
W-2
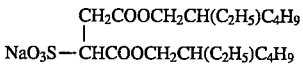
W-3
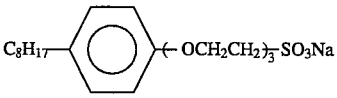
W-4

-continued

W-5

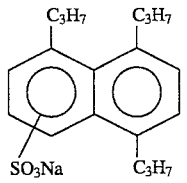

W-6

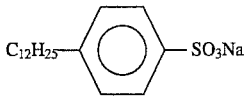

PL-1

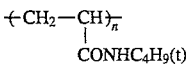

M-1

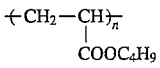

F-1

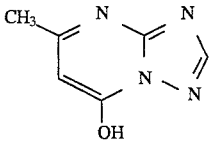

F-2

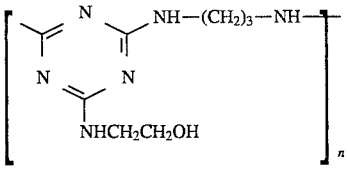

F-3

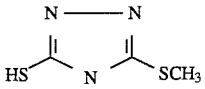

F-4

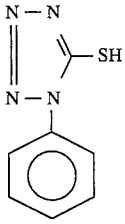

F-5

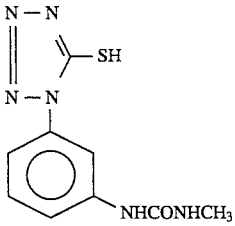

F-6

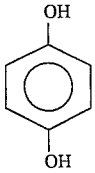

F-7

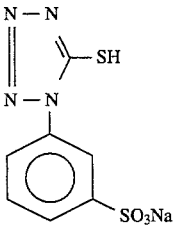

F-8

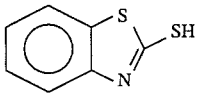

Samples 202 to 210 were prepared as in the same way as Sample 201 except that the emulsion A used in the layer 17 (high-speed blue-sensitive emulsion layer) of Sample 201 was changed to emulsions B-1 to B-5, and C to F, respectively.

The samples 201 to 210 were evaluated in the same manner.

A sample piece from each of the coated samples 201 to 210 was wedge-exposed to white light for an exposure time of 1/100 second and at an exposure amount of 20 CMS via a wedge. Each sample piece was developed as specified below. Then, each sample piece was subjected to sensitometry.

Further, the sample was tested in terms of latent image storability by the method set forth in Example 1.

| Processing Step | Time | Temperature |
|---|---|---|
| 1st development | 6 min. | 38° C. |
| Washing | 2 min. | 38° C. |
| Reversal | 2 min. | 38° C. |
| Color development | 6 min. | 38° C. |
| Pre-bleaching | 2 min. | 38° C. |
| Bleaching | 6 min. | 38° C. |
| Fixing | 4 min. | 38° C. |
| Washing | 4 min. | 38° C. |

-continued

| Processing Step | Time | Temperature |
|---|---|---|
| Final rinsing | 1 min. | 25° C. |

The compositions of the individual processing solutions were as follows.

| (1st developing solution) | |
|---|---|
| Nitrilo-N,N,N-trimethylene-phosphonic acid pentasodium salt | 1.5 g |
| Diethylenetriaminepentaacetic acid pentasodium salt | 2.0 g |
| Sodium sulfite | 30 g |
| Hydroquinone.potassium monosulfonate | 20 g |
| Potassium carbonate | 15 g |
| Sodium bicarbonate | 12 g |
| 1-phenyl-4-methyl-4-hydroxymethyl-3-pyrazolidone | 1.5 g |
| Potassium bromide | 2.5 g |
| Potassium thiocyanate | 1.2 g |
| Potassium iodide | 2.0 mg |
| Diethyleneglycol | 13 g |
| Water to make | 1,000 ml |
| pH | 9.60 |

The pH was adjusted by using sulfuric acid or potassium hydroxide.

| (Reversal solution) | |
|---|---|
| Nitrilo-N,N,N-trimethylene phosphonic acid pentasodium salt | 3.0 g |
| Stannous chloride dihydrate | 1.0 g |
| P-aminophenol | 0.1 g |
| Sodium hydroxide | 8 g |
| Glacial acetic acid | 15 ml |
| Water to make | 1,000 ml |
| pH | 6.00 |

The pH was adjusted by using acetic acid or sodium hydroxide.

| (Color developing solution) | |
|---|---|
| Nitrilo-N,N,N-trimethylene phosphonic acid pentasodium salt | 2.0 g |
| Sodium sulfite | 7.0 g |
| Trisodium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-ethyl-N-(β-methanesulfonamido-ethyl)-3-methyl-4-aminoaniline 3/2 sulfate monohydrate | 11 g |
| 3,6-dithiaoctane-1,8-diol | 1.0 g |
| Water to make | 1,000 ml |
| pH | 11.80 |

The pH was adjusted using acetic acid or potassium hydroxide.

| (Pre-bleaching solution) | |
|---|---|
| Ethylenediaminetetraacetic acid disodium salt dihydrate | 8.0 g |
| Sodium sulfite | 6.0 g |
| 1-thioglycerol | 0.4 g |
| Adduct of formaldehyde with sodium bisulfite | 30 g |
| Water to make | 1,000 ml |
| pH | 6.20 |

The pH was adjusted by using acetic acid or sodium hydroxide.

| (Bleaching solution) | |
|---|---|
| Ethylenediaminetetraacetic acid disodium salt dihydrate | 2.0 g |
| Ammonium ferric ethylenediaminetetraacetate dihydrate | 120 g |
| Potassium bromide | 100 g |
| Ammonium nitrate | 10 g |
| Water to make | 1,000 ml |
| pH | 5.70 |

The pH was adjusted by using nitric acid or sodium hydroxide.

| (Fixing solution) | |
|---|---|
| Ammonium thiosulfate | 80 g |
| Sodium sulfite | 5.0 g |
| Sodium bisulfite | 5.0 g |
| Water to make | 1,000 ml |
| pH | 6.60 |

The pH was adjusted by using acetic acid or ammonia water.

| (Final rinsing solution) | |
|---|---|
| 1,2-benzoisothiazolin-3-one | 0.02 g |
| Polyoxyethylene-p-monononyl-phenylether (average polymerization degree 10) | 0.3 g |
| Polymaleic acid (average molecular weight 2,000) | 0.1 g |
| Water to make | 1,000 ml |
| pH | 7.0 |

The results are shown in Table 8 below.

TABLE 8

| Sample No. | Emulsion used in Layer 17 (High-speed blue sensitive emulsion layer) | Relative sensitivity | Latent image storability (charge in sensitivity after stored at 50° C., 55% for 3 days) |
|---|---|---|---|
| 201 (Present invention) | A | 100 | 0.02 |
| 202 (Present invention) | B-1 | 106 | 0.03 |
| 203 (Present invention) | B-2 | 103 | 0.01 |
| 204 (Present invention) | B-3 | 99 | 0.02 |
| 205 (Present invention) | B-4 | 94 | 0.01 |
| 206 (Present invention) | B-5 | 91 | 0.03 |
| 207 (Present invention) | C | 93 | 0.03 |
| 208 (Comparative example) | D | 74 | 0.10 |
| 209 (Comprative example) | E | 49 | 0.13 |
| 210 (Comparative exmpal) | F | 60 | 0.28 |

The color reversal sensitivity of the layer 17 (high-speed blue-sensitive emulsion layer) was estimated on the basis of the relative exposure amount required to impart a density 2.5 greater by 2.5 than the minimum yellow density, and the latent image storability was evaluated.

As can bee seen Table 8, the samples formed by applying the emulsion of the present invention as the layer 17 (high-speed blue-sensitive emulsion layer) exhibited a high sensitivity and a good latent image storability.

EXAMPLE 3

A multilayer having the below-specified compositions was formed on a subbed triacetylcellurose film substrate having a thickness of 127 μm, thereby obtaining a sample 301.

Each numeral indicates an amount of addition per $m^2$. Note that the effects of each of the compounds are not limited to the usage described.

| | |
|---|---|
| Layer 1: Antihalation layer | |
| Gray colloidal silver | 0.20 |
| Gelatin | 1.9 |
| Layer 2: Interlayer | |
| Gelatin | 1.20 |
| Layer 3: Low-speed red-sensitive emulsion layer | |
| Emulsion a | silver 0.60 |
| silver bromide Lippmann emulsion | silver 0.06 |
| Gelatin | 0.90 |
| Coupler C-1 | 0.20 |
| High boiling point organic solvent Oil-1 | 0.10 |
| Compound Cpd-M | 0.05 |
| Layer 4: High-speed red-sensitive emulsion layer | |
| Emulsion b | silver 0.50 |
| Fine grain silver bromoiodide emulsion (AgI 4.8%) | silver 0.05 |
| Gelatin | 1.50 |
| Coupler C-1 | 0.90 |
| High boiling point organic solvent Oil-1 | 0.40 |
| Layer 5: Interlayer | |

-continued

| | |
|---|---|
| Gelatin | 0.60 |
| Compound Cpd-M | 0.16 |
| Dye D-6 | 0.65 |
| Layer 6: Interlayer | |
| Gelatin | 0.60 |
| Layer 7: Low-speed green-sensitive emulsion layer | |
| Emulsion c | silver 0.45 |
| Gelatin | 0.90 |
| Coupler C-11 | 0.20 |
| Coupler C-7 | 0.07 |
| High boiling point organic solvent Oil-2 | 0.11 |
| Layer 8: High-speed green-sensitive emulsion layer | |
| Emulsion d | silver 0.45 |
| Silver bromide Lippmann emulsion | silver 0.07 |
| Fine grain silver bromoiodide emulsion (AgI 4.8%) | silver 0.05 |
| Gelatin | 1.50 |
| Coupler C-11 | 0.60 |
| Coupler C-7 | 0.25 |
| High boiling point organic solvent Oil-2 | 0.40 |
| Layer 9: Interlayer | |
| Gelatin | 0.60 |
| Layer 10: Interlayer | |
| Gelatin | 0.60 |
| Compound Cpd-M | 0.11 |
| Dye D-7 | 0.27 |
| Layer 11: Low-speed blue-sensitive emulsion layer | |
| Emulsion e | silver 0.45 |
| Gelatin | 0.90 |
| Coupler C-5 | 0.18 |
| High boiling point organic solvent Oil-1 | 0.06 |
| Compound Cpd-M | 0.05 |
| Layer 12: High-speed blue-sensitive emulsion layer | |
| Emulsion A of Example 1 | silver 0.55 |
| Silver bromide Lippmann emulsion | silver 0.07 |
| Fine grain silver bromoiodide emulsion (AgI 4.8%) | silver 0.05 |
| Gelatin | 2.40 |
| Coupler C-5 | 1.55 |
| High boiling point organic solvent Oil-1 | 0.50 |
| Layer 13: First protective layer | |

-continued

| | |
|---|---|
| UV absorbent U-6 | 0.38 |
| UV absorbent U-7 | 0.13 |
| Compound Cpd-M | 0.07 |
| Gelatin | 1.40 |
| Layer 14: Second protective layer | |
| Gelatin | 0.97 |
| Silver bromide Lippmann emulsion | silver 0.12 |
| Yellow colloidal silver | silver 0.003 |
| Gelatin hardener H-2 | 0.31 |

The compounds used are listed below.

| | |
|---|---|
| Cpd-M | (N'-{2-[4-hydroxyphenylsulfonyl)phenoxy] dodecanoyl}-N-[4(2-pentyloxy)phenyl]hydrozine) |
| D-6 | (1,3-bis[(1-{4-carboxylphenyl}-3-methyl-2-pyrazoline-5-one(4)]trimethineoxonol) |
| D-7 | (4-(4-(butanesulfoneamidophenyl)-3-cyano-5-furfurylidene-2,5-dihydro-2-furanon) |
| U-6 | (2-(2H-benzotriazole-2-yl)-4,6-bis(1,1-dimethyl-propyl)phenol) |
| U-7 | (3-(di-n-dihexylamino)allylidenemalononitrile) |
| H-2 | Bis(vinylsulfonyl)methane |

The silver bromoiodide emulsions used in the sample 301 are indicated Table 9 below.

TABLE 9

| Emulsion | Grain shape | AgI Content (%) | Average equivalent-circular diameter (μm) | Average thickness (μm) | Aspect ratio | Ratio of tabular grains in terms of projected area (%) | Variation coefficient of distribution of grain size % | Sensitization dye used |
|---|---|---|---|---|---|---|---|---|
| a | tabular | 3.5 | 0.8 | 0.160 | 5.0 | 98 | 8.0 | S-2/S-3 |
| b | tabular | 2.0 | 1.8 | 0.180 | 10.0 | 100 | 4.5 | " |
| c | tabular | 3.5 | 1.0 | 0.118 | 8.5 | 100 | 5.0 | S-4/S-5 |
| d | tabular | 1.5 | 2.0 | 0.133 | 15.0 | 99 | 5.0 | " |
| e | tabular | 3.5 | 1.2 | 0.099 | 12.1 | 98 | 6.0 | S-6/S-7 |
| f | tabular | 2.0 | 2.0 | 0.180 | 11 | 99 | 5.0 | " |

Samples 302 to 310 were prepared as in the same way as Sample 301 except that the emulsion A used in the layer 12 (high-speed blue-sensitive emulsion layer) of Sample 301 was changed to emulsions B-1 to B-5, and C to F, respectively.

The samples 301 to 310 were evaluated in the same manner as in Example 2. The results obtained were similar to those of Example 2.

EXAMPLE 4

The samples 201 to 210 were evaluated in the same manner as in Example 2 except that the first developing solution of Example 2 was changed to that indicated below. The results obtained were similar to those of Example 2.

-continued (First development solution)

| | Mother Solution | Replenishment Solution |
|---|---|---|
| Pentasodium nitrilo-N,N,N-trimethylene phosphonate | 3.0 g | 3.0 g |
| Pentasodium diethylene-triamine pentaacetate | 3.0 g | 3.0 g |
| Potassium sulfite | 30.0 g | 30.0 g |
| Potassium hydroquinone-monosulfonate | 27.0 g | 33.0 g |
| Potassium carbonate | 33.0 g | 33.0 g |
| 1-phenyl-4-methyl-4-hydroxymethyl-3-pyrazolidone | 1.7 g | 2.0 g |
| Potassium bromide | 5.2 g | — |
| Potassium thiocyanate | 1.2 g | 1.3 g |
| Potassium iodide | 0.015 g | — |
| Water to make | 1000 ml | 1000 ml |
| pH (25° C.) | 9.70 | 9.85 |

The pH was adjusted by KOH/sulfuric acid.

By using the mother solution and replenishment solution prepared as above, the running treatment was conducted at a replenishing amount of 500 ml per 1 $m^2$ of light-sensitive material until the total replenishment amount is three times as much as the capacity of the black-and-white developing tank.

After the running, the potassium bromide concentration was 5.5 g/liter, the potassium iodide concentration was 0.014 g/liter, and the pH was 9.80.

EXAMPLE 5

Samples 502 to 510 were prepared as in the same way as light-sensitive material 1 of Example 1 disclosed in JP-A-2-93641 except that the silver bromoiodide emulsion used in the layer 13 of this material 1 was changed to emulsions B-1 to B-5, and C to F set forth in Example 1 of the present invention, respectively. These samples were processed in the same manner as Example 1 of the above document. The results obtained were as good as those of the Examples of the present invention.

What is claimed is:

1. A silver bromoiodide photographic emulsion comprising tabular silver bromoiodide grains having an aspect ratio of 2 or more in an amount of 70% or more based on a total projected area of all grains, wherein a variation coefficient of the grain size distribution of all silver halide grains in said emulsion is 10% or less, and the silver iodide content of the silver bromoiodide emulsion is 5 mol % or less, said emulsion exhibiting, under X-ray diffraction analysis with the $K_\alpha$ line of Cu, a (420) X-ray diffraction signal having at least two peaks and a peak interval of at least 0.1 degree in terms of the diffraction angle, and wherein said peaks are present, measuring at 13% of a maximum peak height, within a 1.4 degree diffraction angle range.

2. The emulsion according to claim 1, wherein 70% or more of the grains based on a total projected area of all grains are tabular silver bromoiodide grains having an aspect ratio of 5 or more.

3. The emulsion according to claim 1, wherein said signal has two peaks.

4. The emulsion according to claim 1, wherein said peak interval is in the range of from 0.1 degrees to less than 1.3 degrees in terms of the diffraction angle.

5. The emulsion according to claim 1, wherein said tabular silver bromoiodide grains each have 10 or more dislocation lines.

6. The emulsion according to claim 1, wherein a relative standard deviation of a silver iodide content distribution of individual silver bromoiodide grains is 20% or less.

7. A silver halide photographic light-sensitive material comprising at least one silver halide emulsion layer on a support, wherein at least one silver halide emulsion layer contains the silver bromoiodide emulsion of claim 1.

8. The light-sensitive material according to claim 7, wherein said silver halide emulsion layer contains a polymer whose repeating unit is represented by the following Formula (I) or Formula (II):

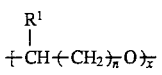

Formula (I)

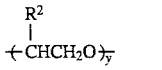

Formula (II)

where in formula (I), $R^1$ represents a hydrogen atom, an alkyl group having 1 to 10 carbon atoms, or an aryl group having 6 to 10 carbon atoms, and n represents an integer of 1 to 10, provided when n=1, $R^1$ is not a hydrogen atom; and in formula (II), $R^2$ represents a hydrogen atom or a lower alkyl group substituted with a hydrophilic group and having 4 or less carbon atoms, and each of x and y represents the number of repeating units, x being 2 to 1000, and y being 1 to 1000.

9. The light-sensitive material according to claim 8, wherein said polymer has been added in said emulsion during nucleation, ripening or growing of said silver bromoiodide grains.

10. The emulsion according to claim 1, wherein the silver iodide content of the silver bromoiodide emulsion is 3 mol % or less.

11. An emulsion comprising silver halide grains dispersed in gelatin, said silver halide grains comprising silver bromoiodide tabular grains having a silver iodide content of 3 mol % or less and an aspect ratio of 2 or more, said tabular grains accounting for at least 70% of all of the grains in the emulsion, based on projected surface area, said emulsion exhibiting, under X-ray diffraction analysis with the $K_\alpha$ line of Cu, a (420) X-ray diffraction signal having two peaks with a peak interval therebetween in the range of 0.1 to 1.3 degrees in terms of the diffraction angle, and wherein said peaks are present, measuring at 13% of a maximum peak height, within a 1.4 degree diffraction angle range, and wherein a variation coefficient of the grain size distribution of all silver halide grains in said emulsion is 10% or less.

* * * * *